US009376879B2

(12) United States Patent
Mizuguchi

(10) Patent No.: US 9,376,879 B2
(45) Date of Patent: Jun. 28, 2016

(54) CORE SAMPLING APPARATUS AND CONTAINER TRANSFER APPARATUS

(71) Applicant: Japan Agency for Marine-Earth Science and Technology, Yokosuka-shi, Kanagawa (JP)

(72) Inventor: Yasuhiko Mizuguchi, Yokosuka (JP)

(73) Assignee: JAPAN AGENCY FOR MARINE-EARTH SCIENCE TECHNOLOGY, Kanagawa (JP)

( * ) Notice: Subject to any disclaimer, the term of this patent is extended or adjusted under 35 U.S.C. 154(b) by 606 days.

(21) Appl. No.: 13/863,696

(22) Filed: Apr. 16, 2013

(65) Prior Publication Data

US 2014/0262532 A1 Sep. 18, 2014

(30) Foreign Application Priority Data

Mar. 15, 2013 (JP) ..... 2013-053301

(51) Int. Cl.
*E21B 25/00* (2006.01)
*E21B 25/08* (2006.01)

(52) U.S. Cl.
CPC ..... *E21B 25/08* (2013.01); *E21B 25/005* (2013.01); *E21B 25/00* (2013.01)

(58) Field of Classification Search
CPC ..... E21B 25/08; E21B 25/005; E21B 25/00
See application file for complete search history.

(56) References Cited

U.S. PATENT DOCUMENTS 2,445,494 A * 7/1948 Redmond ..... E21B 25/08 175/233
3,454,117 A * 7/1969 Eckel ..... E21B 25/08 175/226
3,833,074 A 9/1974 Courtois
4,230,192 A * 10/1980 Pfannkuche ..... E21B 25/08 175/233
4,317,490 A * 3/1982 Milberger ..... E21B 25/04 175/20
6,216,804 B1 4/2001 Aumann et al.
6,659,204 B2 * 12/2003 Aumann ..... E21B 25/08 175/17

FOREIGN PATENT DOCUMENTS

JP 4868402 A 9/1973

OTHER PUBLICATIONS

Masayuki Kawasaki, et al., "Pressure Temperature Core Sampler (PTSC)", Journal of the Japanese Association for Petroleum Technology, vol. 71, No. 1, Jan. 2006, with partial English translation.
Yasuhiko Mizuguchi et al., "Development of the Hybrid Pressure Core Sampler", Proceedings of the Individual Lectures at the 2012 Spring Meeting and Symposium of the Japanese Association for Petroleum Technology, Jun. 2012, with partial English translation.
International Preliminary Report on Patentability mailed Sep. 24, 2015, corresponding to International patent application No. PCT/JP2014/056345.

* cited by examiner

*Primary Examiner* — Nicole Coy
(74) *Attorney, Agent, or Firm* — Hauptman Ham, LLP

(57) ABSTRACT

Provided is a core sampling apparatus which maintains the internal pressure after the core drilling.
The core sampling apparatus includes a barrel part, a container which is movably disposed in the barrel part and maintains the sampled core, a ball valve to prevent a fluid from inflowing and outflowing between an inside and an outside of the barrel part in a closed state thereof, a first seal member which seals a space between the barrel part and the ball valve, a second seal member which seals a space between the container and the barrel part, a locking mechanism which locks a state in which the ball valve is sealed by the first seal member, and an inflowing mechanism configured to inflow the fluid only in a direction to an internal space of the closed barrel part by the first seal member and the second seal member.

5 Claims, 18 Drawing Sheets

(A)

(B)

CORE SAMPLING APPARATUS AND CONTAINER TRANSFER APPARATUS

RELATED APPLICATIONS

The present application is based on, and claims priority from, Japanese Application Number 2013-053301, filed Mar. 15, 2013, the disclosure of which is hereby incorporated by reference herein in its entirety.

BACKGROUND OF THE INVENTION

1. Field of the Invention

The present invention relates to a core sampling apparatus that samples a core while maintaining an internal pressure of the apparatus and a container transfer apparatus that transfers a container in the core sampling apparatus to a predetermined apparatus.

2. Related Background Art

In scientific drilling, etc., although many researchers and engineers have been making developments for the purpose of obtaining a stratum column-shaped sample (a core) with a pressure in the stratum maintained for many years, they are still far from completion. Recently, in oil field drilling, there has been a special coring system called a "pressure temperature core sampler (PTCS)", which has been developed mainly for the purpose of obtaining a core of methane hydrate, in particular under pressurized conditions (that is, in a hydrate condition) (see Patent Literature 1 (U.S. Pat. No. 6,216,804)). This PTCS is provided with a thermal electronic cooling apparatus and has a characteristic that it can perform recovery while preventing the vaporization of methane hydrate since it performs to maintain a pressure and cool.

If the core is drilled and recovered using the PTCS, the recovery time is short, and thus the temperature rise during the recovery does not cause much of a problem. In consideration of this, there is also an NC-PTCS, which aims to improve the pressure maintainability by removing a cooler, and further solving the problem that a rotation angle of a ball valve rotated by a link is inaccurate, and improving an ability to stop at a designated position (see Non-Patent Literature 1 ("Pressure Temperature Core Sampler (PTCS)—Core Sampling Technology for Maintaining Pressure and Temperature" by Kawasaki, Umezu, and Yasuda, Journal of The Japanese Association for Petroleum Technology Vol. 71, No. 1, The Japanese Association for Petroleum Technology, January 2006)).

However, even in this NC-PTCS, since an apparatus for sampling a column-shaped sample (a core sampling apparatus) has a large outer diameter, it is also difficult to drilled by using a conventional drill pipe. Further, the NC-PTCS includes no consideration of moving the core to an analyzing device while maintaining real pressure conditions below the seabed. In order to solve these shortcomings and recover the core while maintaining a real pressure environment below the seabed, a core sampling apparatus which recovers the core while maintaining an internal pressure of the core sampling apparatus has been developed (for example, see Non-Patent Literature 2 ("Development of Hybrid PCS (pressure conserving core)," by Mizuguchi, Kobayashi, and Inada, Collection of Summaries of special lectures, symposiums and private lectures at the spring lecture meeting of The Japanese Association for Petroleum Technology, 2012, The Japanese Association for Petroleum Technology, June 2012). This core sampling apparatus (a core barrel) includes a running and retrieving unit (a detaching unit) located in an upper portion thereof, a pressure control part located in a middle part thereof, and a core sampling unit (an autoclave) which is located in a lower portion thereof and provided with a pressure conserving function.

In order to obtain a core, for the purpose of inserting the core into a core liner (a container for recovering the core) located in the autoclave by drilling, the core sampling apparatus should have a structure in which internally circulating mud water is released from the upper portion thereof. In order to maintain a pressure in the core barrel, it is possible to maintain pressure tightness in the autoclave by blocking an upper hole formed on the upper portion of the autoclave positioned in the lower portion of the core barrel and closing an openable and closable ball valve located in the lower portion of the autoclave. This ball valve has a structure in which a pressure can be maintained by sealing only a portion that penetrates the ball valve by disposing a ball valve seal in the upper portion of the ball valve; thus the ball valve has a structure whereby it is possible to form the autoclave itself with a small outer diameter and obtain a core having an outer diameter sufficient for analysis.

In the ball valve, when a spring retainer (a sleeve) located in the upper portion of the ball valve is removed, the ball valve is moved downward by pushing the ball valve with the spring, whereby rotation of the ball valve is controlled, and the ball valve can be closed as it is rotated just like rolling. After that, by using an accumulator disposed in the pressure control part, pressurized water adjusted to apply a pressure higher than the pressure of the stratum is injected. Therefore, it becomes possible to maintain the internal pressure of the autoclave higher than the pressure at the seabed, and the core is recovered to the surface of the earth with an improved ability to maintain pressure. This pressure adjusting function can be used to adjust the pressure maintenance by pressurizing to a set pressure automatically even when the pressure in the autoclave leaks while the core is being recovered to the surface of the earth.

SUMMARY OF THE INVENTION

In the above-mentioned core sampling apparatus, the ball valve is closed in a state in which a circulation hole for core sampling on the upper portion of the autoclave is sealed, but the ball valve seal also needs a seal area for maintaining the seal performance. Further, when the ball valve is moved downward by a spring force and rotates to close the hole, if the ball valve moves further from the edge of the ball valve seal, it may be necessary to increase the internal volume according to the movement. Because of this, the ball valve may stop at the edge, and is not sealed perfectly. That is, it becomes semi-closed or insufficiently closed.

Further, in this semi-closed state, if the inside of the autoclave having the core liner with the core contained therein, an inner tube and an upper inner tube sub, etc. is moved upward to operate the accumulator, the volume in the autoclave is changed.

Since the upper portion is also sealed, as a result, the internal pressure decreases, which results in the external pressure becoming greater than the spring force, and the ball valve opens again. Thus, when the pressurized water is injected after the ball valve is opened, the pressurized water leaks from the ball valve, the internal pressure is rarely to increase enough to raise the pressure tightness.

The internal pressure may be decreased by this pressure from a hole bottom pressure (a hydraulic head pressure) even when the core can be recovered to this state. During the recovery of the core barrel, the ball valve stops once at the edge, but only a small area is sealed, and the external pressure equilibrates with the internal pressure at the hole bottom that was once closed. Therefore, the ball valve is easily moved due to vibration caused during the recovery (the rise), and the pressure tightness thereof cannot be maintained. Accordingly, the hydraulic head pressure and the internal pressure become equal, and the pressure in the autoclave becomes the pressure at the stable point in time, and thus unevenness occurs in pressure maintenance at the hole bottom.

Depending on the drilling state, core sampling from a stratum which is apt to collapse may be desired. However, in the case of the stratum that is apt to collapse, drilling mud water may be circulated at a high pressure after the core drilling to prevent collapse.

In such a case, because the ball valve is maintained by a spring force, it is easily moved upward and opened by the externally circulating mud water. Therefore, it is more difficult to recover the core from such a stratum, and flowing of the core can also be considered. As a result, the core recovery rate is lowered.

To solve such problems, it is an object of the present invention to provide a core sampling apparatus in which it is possible to maintain a state in which a ball valve is closed during recovery of a core after core drilling and maintain an internal pressure, and a container transfer apparatus.

In order to accomplish the above object, a core sampling apparatus according to an embodiment of the present invention which samples a core, includes: a barrel part; a container which is movably disposed in the barrel part in an axial direction of the barrel part and maintains the sampled core; a ball valve which is disposed at one opening portion side of the barrel part to prevent a fluid from inflowing and outflowing between an inside and an outside of the barrel part through the one opening portion in a closed state thereof; a first seal member which seals a space between the one opening portion of the barrel part and the ball valve in the state that the ball valve is closed; a second seal member which seals a space between an outer peripheral surface of the container and an inner peripheral surface of the barrel part when the container is positioned at a specific position in the axial direction of the barrel part; a locking mechanism which locks a state that the ball valve is sealed by the first seal member; and an inflowing mechanism configured to inflow the fluid only in a direction to an internal space of the closed barrel part by the first seal member and the second seal member, wherein the inflowing mechanism includes at least one of a check valve disposed at a position between the internal space of the barrel part and an outside thereof, and the second seal member which is a lip seal.

The core sampling apparatus according to the embodiment of the present invention can maintain the state in which the ball valve is closed by the locking mechanism for be locked in the sealed state after the ball valve is sealed by the first sealing member. Further, since the core sampling apparatus has an inflowing mechanism enabling the inflow of a fluid only in the internal space of the barrel part, it becomes possible to flow the fluid into the pipe. It is thereby possible to prevent the ball valve from being opened again or the like by increasing the volume of the internal space of the barrel part and causing the pressure to decrease when the container is moved after the ball valve is closed once. Therefore, it is possible to maintain the pressure even when the volume is varied by the movement of the container.

The ball valve may open and close by rotating about a rotary axis while moving in the axial direction of the barrel part, and may further include a supporting part which movably supports the ball valve. According to this configuration, the core sampling apparatus rotates the ball valve so as to move the ball valve, and can support the ball valve by the supporting part.

The barrel part may include: a sealing barrel part whose gap with the ball valve is sealed by the first seal member; and a barrel part body which covers at least a part of an outer peripheral surface of the sealing barrel part and is movably disposed together with the sealing barrel part, wherein the locking mechanism includes: the supporting part which supports the ball valve from a side opposite to a side sealed by the first seal member in the axial direction of the barrel part, in a state in which the ball valve is closed; a groove which is formed in a circumferential direction at a position that does not cover the sealing barrel part on an inner peripheral surface of the barrel part body; and a locking barrel part which has a flange portion, and a claw portion formed to protrude out of the outer peripheral surface, wherein the claw portion is fitted into the groove of the barrel part body in the state in which the ball valve is closed, and the sealing barrel part is locked with respect to the ball valve as the claw portion is fitted into the groove, wherein the locking barrel has an elastic body disposed at a side opposite to the ball valve in an outer periphery of the locking barrel part, and the locking barrel part is pressed by a biasing force of the elastic body that presses the flange portion to the ball valve side, so that the sealing barrel part is pressed so as to lock the sealing barrel part.

According to the core sampling apparatus having this configuration, the locking barrel part and the sealing barrel part are locked to the barrel part body, as the claw portion formed to protrude out of the outer peripheral surface of the locking barrel part is fitted into the groove of the inner peripheral surface of the barrel part body. The ball valve which is supported so as to be sandwiched between the sealing barrel part and the supporting portion is locked to the barrel part body as the sealing barrel part located in the upper portion of the ball valve is locked and becomes unable to move to the barrel part body. Therefore, it is possible to maintain the sealed state by the first sealing member, the ball valve and the sealing barrel part.

The groove of the barrel part body may be formed by a convex portion formed on the inner peripheral surface of the barrel part body, and may be disposed at a predetermined interval in the circumferential direction on the inner peripheral surface of the barrel part body, the claw portion of the locking barrel part may be formed on the outer peripheral surface of the locking barrel part at an interval longer than the interval between the grooves of the barrel part body, and the sealing barrel part and the locking barrel part may be connected to each other. According to the core sampling apparatus having this configuration, the sealing barrel part and the locking barrel part are connected to each other, so that when the sealing barrel part is rotated, the locking barrel part can also be rotated, and by this rotation, the claw that is fitted into the groove is unlatched from the groove. Therefore, it becomes possible to release the locked state of the barrel part body and the locking barrel part.

The locking barrel part may have a second claw portion alternately arranged with the claw portion in the circumferential direction of the outer peripheral surface and formed at the ball valve side relative to the claw portion, the barrel part body may further include a second convex portion which is formed at the other opening portion side of the convex portion that forms the groove on the inner peripheral surface of the barrel part body and has a slope that increases toward the other opening portion, and a distance from the claw portion to the second claw portion is longer than a distance from the convex portion to the second convex portion. According to the core sampling apparatus having this configuration, the sealing barrel part and the locking barrel part connected to each other, so that if the sealing barrel part is rotated, the locking barrel part can also be rotated, and by this rotation, the claw that is fitted into the groove is unlatched from the groove. In that state, if the sealing barrel part and the locking barrel part are pressed to a side opposite to the ball valve, and are rotated with the second claw in contact with the groove to be pressed more, it is possible to return to the state before the ball valve is closed.

The barrel part may include: a sealing barrel part whose gap with the ball valve is sealed by the first seal member; and a barrel part body which covers at least a part of an outer peripheral surface of the sealing barrel part and is movably disposed with respect to the sealing barrel part, wherein the locking mechanism may include: the supporting part which supports the ball valve from a side opposite to a side sealed by the first seal member in the axial direction of the barrel part, in a state in which the ball valve is closed; a blade portion which is mounted on the outer peripheral surface of the sealing barrel part and is expanded in the radial direction of the sealing barrel part toward the barrel part from the ball valve; and a blade supporting part which is locked to the barrel part body, and abuts each other with the blade portion in the state in which the ball valve is closed. According to the core sampling apparatus having this configuration, the blade portion is supported with the ball valve closed, whereby it is possible to maintain the state sealed by the first sealing member, the ball valve, and the sealing barrel part.

The ball valve may have an opening and closing control groove that controls the opening and closing of the ball valve; in the opening and closing control groove, the position corresponding to the state that the ball valve is closed is deeper than the other position, and the locking mechanism includes a pin which is positioned in the opening and closing control groove, and configured to be pressed to a position corresponding the state in which the ball valve is closed. According to the core sampling apparatus having this configuration, the operation of the ball valve is locked as the pin is locked, whereby it is possible to maintain the sealed state of the first sealing member.

In addition, a container transfer apparatus according to an embodiment of the present invention which transfers a container from the core sampling apparatus according to the above aspect to its own container transfer apparatus, includes: a fluid maintaining unit configured to dispose the core sampling apparatus, maintain a pressurized fluid according to a pressure of a fluid in a barrel part of the core sampling apparatus, and connect a space which maintains the fluid when the core sampling apparatus is disposed with the other opening portion of the barrel part; a fluid supply unit which is connected to the inflowing mechanism to supply the fluid; and a container transfer unit which transfers the container into the fluid maintained by the fluid maintaining unit from the other opening portion of the barrel part.

That is, the container transfer apparatus can supply the amount of fluid corresponding to the increase in volume in the barrel part through the fluid supply unit when the container is transferred into the fluid of the fluid maintaining unit, and even in the situation in which the sealing state is fixed by the first sealing member, it is possible to transfer the container into the fluid of the fluid maintaining unit. Further, the pressure of the fluid maintained by the fluid maintaining unit is corresponding to the pressure of the fluid in the barrel part. Therefore, it is possible to transfer the container into the fluid of the fluid maintaining unit while maintaining the pressure in the barrel part of the core sampling apparatus.

In the embodiment of the present invention, it is possible to maintain the state in which the ball valve is closed and maintain the internal pressure of the apparatus by providing the locking mechanism for locking the sealed state after the ball valve sealed by the first sealing member.

DESCRIPTION OF THE PREFERRED EMBODIMENTS

Hereinafter, embodiments of a core sampling apparatus and a container transfer apparatus according to the present invention will be described in detail with reference to the drawings. Meanwhile, in the description of the drawings, identical elements have assigned identical symbols, and duplicate description thereof is omitted. Further, the dimensional ratios of the drawings do not necessarily accord with what is described.

(Configuration of Core Barrel)

Figure 1:
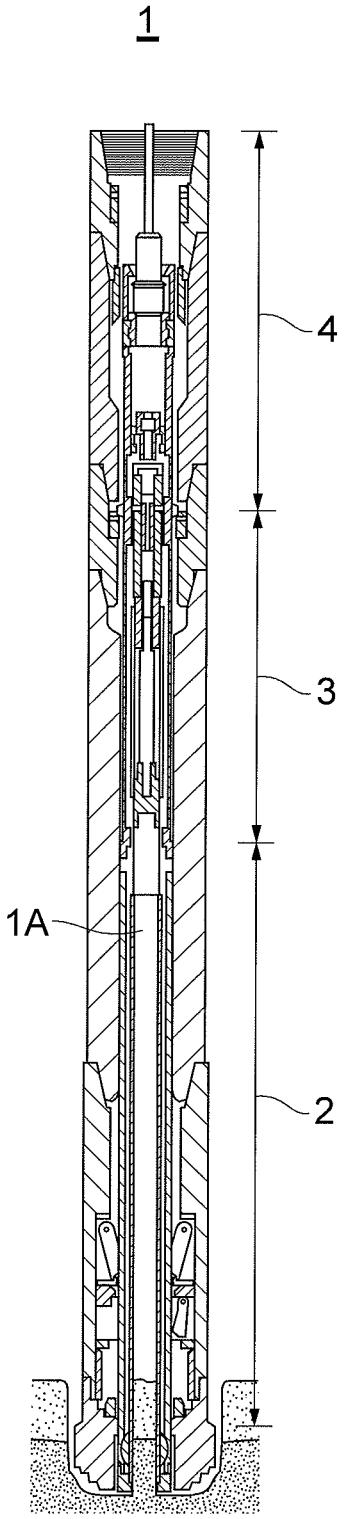
FIG. 1 is an overall view of a core barrel.

FIG. 1 shows a core barrel 1 (a core sampling apparatus) according to the present embodiment. As shown in FIG. 1, the core barrel 1 includes an autoclave 2 for sampling a core, a pressure control part 3 for maintaining an internal pressure of the core barrel 1, and a pull-up unit 4 for pulling up the autoclave 2, in order from a lower side at the core drilling condition. The autoclave 2 includes a container (a core liner) which is movably disposed in an axial direction in a barrel part (an inner barrel) 1A forming the inside of the core barrel 1, a mechanism which stores the container in a pressure-maintained state, and a cutting part. The core is recovered from the seabed, etc. by the cutting part. The pressure control part 3 is provided with at least an accumulator, and controls a pressure of the autoclave 2 by flowing pressurized water into the core barrel 1 from the accumulator. The pull-up unit 4 pulls up the autoclave 2 by the wire. Meanwhile, in the core barrel 1, the size of the core recovered by core drilling work may be an outer diameter of 51 millimeters and a length of 3.50 meters. Hereinafter, the side of the autoclave 2 will be described as a lower side and the side of the pull-up unit 4 as an upper side, as seen from the pressure control part 3.

Figure 2:
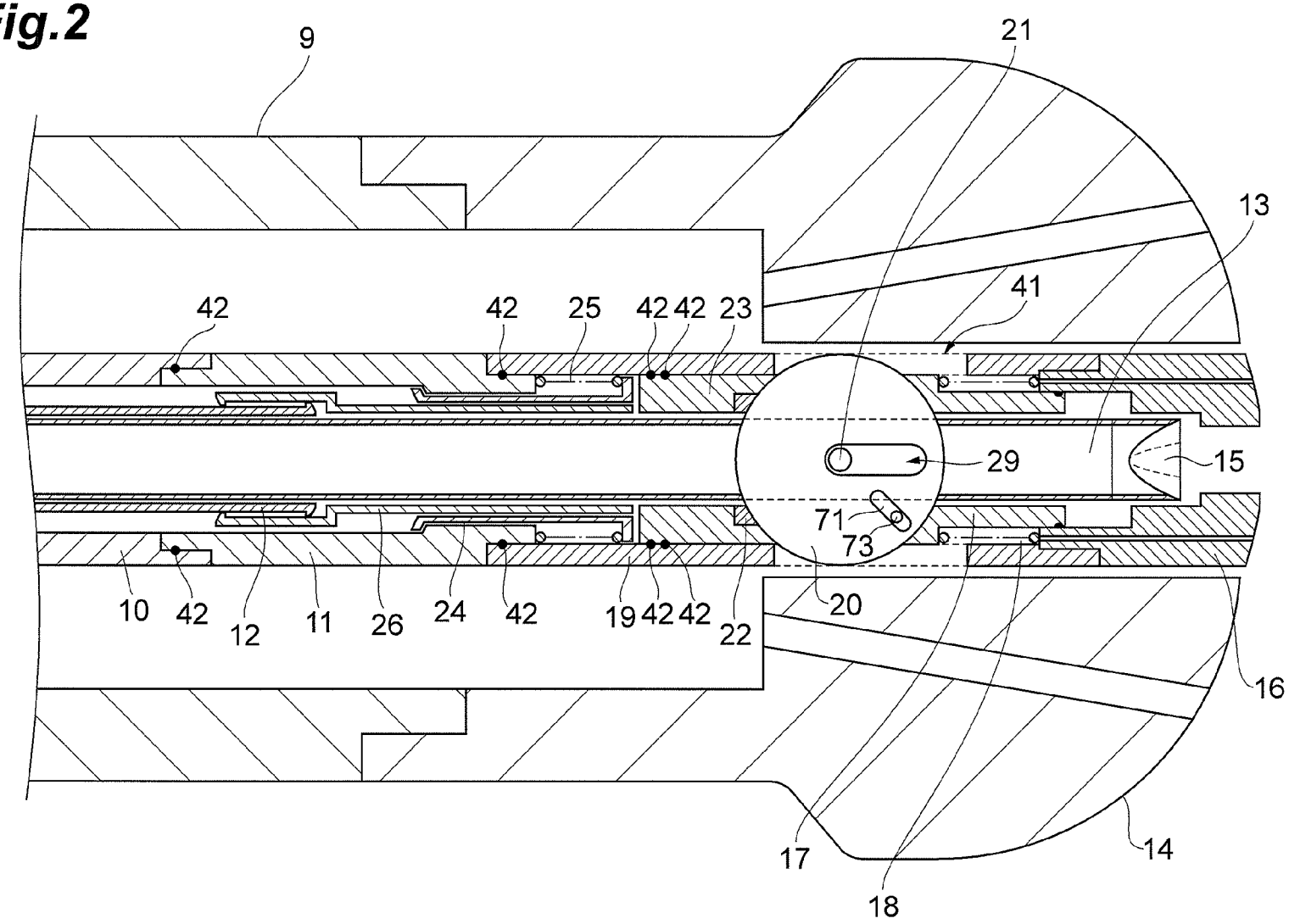
FIG. 2 is a cross-sectional view (1) of a conventional autoclave.

Next, the basic configuration of the tip portion of the autoclave 2 will be described using FIG. 2. FIG. 2 is a cross-sectional view of the autoclave 2. Meanwhile, the characteristic configuration according to the present embodiment to be described later is not necessarily shown in the configuration of FIG. 2. Further, the configuration shown in FIG. 2 is the same as that of a conventional autoclave 2.

The autoclave 2 includes an outer barrel 9, an outer tube 10, a drive sub 11, an inner tube 12, a core liner 13, a bit 14, a core catcher 15, a cutting shoe 16, a ball follower 17, a return spring 18, a ball valve housing 19, a ball valve 20, a pivot screw 21, a ball valve seal 22, a seal carrier 23, a spring collet 24, a ball valve spring 25, a release sleeve 26, and O rings 42 at a front end portion thereof.

The outer barrel 9 is a cylindrical outer tube of the core barrel 1. The outer tube 10 is a cylinder tube and is positioned in the outer barrel 9. The drive sub 11 is connected to a lower end of the outer tube 10 through O rings 42, and is a tubular member. The drive sub 11 has a convex portion in an inner circumferential direction. The inner tube 12 is a cylindrical member, and is disposed inside the outer tube 10 and the drive sub 11. Further, the inner tube 12 has a claw portion 28 outwardly protruding from a lower end portion of the inner tube 12. The inner tube 12 is movably disposed in an axial direction in the outer tube 10 and the drive sub 11. The core liner 13 is a cylindrical container internally in contact with the inner tube 12 and contains the sampled core. The bit 14 is formed at the lower end of the outer barrel 9. The bit 14 has a bit cutting edge such as a cemented carbide tip or a diamond tip formed at or near the front end, and a mechanism used to drill the ground directly. The core catcher 15 is disposed at the lower end of the core liner 13 so as to prevent the recovered core from falling out of the core liner 13 by the core catcher 15.

The cutting shoe 16 is disposed so as to cover the lower end of the core liner 13. The cutting shoe 16 is a steel cutting part, which is a member having a sufficient rigidity, and cuts ground. The core, which is obtained as a result of the cutting shoe 16 cutting the ground, is recovered into the core liner 13. The ball follower 17 is disposed on the cutting shoe 16. The ball follower 17 is a cylindrical member. The return spring 18, which is an elastic body, is disposed on the outer periphery of the ball follower 17. The return spring 18 presses an end face of the cutting shoe 16 and the ball follower 17. The ball follower 17 presses the ball valve 20 disposed on the ball follower 17 so as to support the ball valve 20. The ball follower 17 is a supporting part.

The ball valve housing 19 is a cylindrical member which is disposed at an upper side of the core catcher 15, and covers the ball follower 17, the return spring 18, the ball valve 20, the ball valve seal 22, the seal carrier 23, the spring collet 24, and the ball valve spring 25. In addition, through-holes 29 are formed on two sides to make a pair of ball valve housings 19 in the axial direction. Through-holes 41 are formed on sides of the direction different from the side in which the through-holes 29 are formed, and therefore it is possible to manipulate the seal carrier 23 through the through-holes 41 when the ball valve 20 is closed.

The ball valve 20 is disposed to move while turning axially along the through-holes 41 in a position in which the through-holes 41 of the ball valve housing 19 is formed. The ball valve 20 is a valve that can be opened and closed by rotary movement, and is disposed on the lower opening side of the inner tube 12 to prevent the fluid from inflowing and outflowing between the cylindrical internal space of the upper side (the inner tube 12 side) and the outside in a closed state. In the state in which the ball valve 20 is in contact with the upper side forming the through-holes 41 of the ball valve housing 19 (the state shown in FIG. 2), a hole through which the fluid of the ball valve 20 flows in and flows out faces in the axial direction. Therefore, the inflow and outflow of the fluid between the internal space and the outside is possible. That is, the ball valve 20 is open in this state. As shown in FIG. 2, in this state, the core liner 13 penetrates the hole through which the fluid of the ball valve 20 flows in and flows out.

The pivot screw 21 is mounted on a side of the ball valve 20 where the moving direction and the vertical direction form a pair. This pivot screw 21 is a screw member. In the state in which the pivot screw 21 is mounted at the side of the ball valve 20, the pivot screw 21 is disposed in the through-hole 29 of the ball valve housing 19. Thereby, an operation range of the pivot screw 21 is formed with the through-hole 29. That is, in a moving range of the ball valve 20, the ball valve also can operate only in a range corresponding to the range of the through-holes 29. Further, a pivot hole 71, which is a groove for rotation control, is formed in a side of the ball valve 20 in a direction vertical to the moving direction of the ball valve. A face of the ball valve 20, on which the pivot screw 21 is mounted and the pivot hole 71 is formed, is formed in a circular plane. Further, the pivot hole 71 extends in a radial direction from a position slightly apart from the circular center, which is the position where the pivot screw 21 is mounted, to a front end of the circular plane.

A pivot pin 73 configured to rotate the ball valve 20 is locked on the inner peripheral surface of the ball valve housing 19. The pivot pin 73 is a bar-shaped member, and is disposed such that the axial direction of the bar faces the center of the ball valve housing 19. The pivot pin 73 has a thread (a thread groove) cut on the outer periphery thereof, and is fixed to the ball valve housing 19 by screwing the thread in a screw hole 40 formed in the inner peripheral surface of the ball valve housing 19. Further, the position at which the pivot pin 73 is disposed is a position at the same level as the upper end portion of the through-holes 29 in the axial direction, and a position deviated from the through-hole 29 in the circumferential direction. The pivot pin 73 is fitted into the pivot hole 71. With the ball valve 20 opened, the pivot hole 71 extends downward at 45 degrees with respect to the axial direction. Further, with the ball valve 20 opened, the pivot pin 73 is positioned at a position apart from the pivot screw 21 in the pivot hole 71. When the ball valve 20 moves downward, the position of the pivot pin 73 moves once to a position close to the pivot screw 21 in the pivot hole 71, and finally moves to a position away from the pivot screw 21. Thereby, the ball valve 20 rotates to close the ball valve 20.

The ball valve seal 22 (a first sealing member) is positioned on the ball valve 20, seals a space between the lower opening portion of the barrel part (for example, the seal carrier 23 to be described later) and the ball valve 20, with the ball valve 20 closed, and is a cylindrical member in accord with the shape of the seal-side end portion of the barrel part. The seal carrier 23 is positioned at the upper side of the ball valve seal 22, and is a cylindrical member pressing the ball valve 20 from above. The seal carrier 23 serves as a barrel part and a sealing barrel part. The spring collet 24 of a cylindrical member, and the ball valve spring 25 of the elastic body disposed on the outer periphery of the spring collet 24 are disposed at the upper side of the seal carrier 23. The ball valve spring 25 is positioned between a face facing the upper side of the flange portion 48 of the spring collet 24 and a lower end face of the drive sub 11, and presses these to push the seal carrier 23 in contact with the flange portion 48 downward (toward the ball valve 20) by an upper end face thereof. Accordingly, the ball valve seal 22 is pushed downward (toward the ball valve 20) by the seal carrier 23, and thereby a space between the ball valve 20 and the seal carrier 23 is sealed. Meanwhile, the spring collet 24 is a cylindrical member disposed in the outer tube 10 or the drive sub 11, and corresponds to the barrel part and the locking barrel part. In addition, the release sleeve 26 is disposed immediately inside of the spring collet 24 in the radial direction. The release sleeve 26 is a cylindrical member, and has a claw portion 43 which protrudes in a radially inward direction and is formed at an upper end portion of the release sleeve 26. The upper end portion of the release sleeve 26 is positioned to overlap the lower portion of the inner tube 12 in the axial direction, and is positioned outside of the inner tube 12 in the radial direction. In addition, the spring collet 24 is sandwiched between the outer tube 10 or the drive sub 11 and the release sleeve 26.

The spring collet 24 has a claw portion formed at an upper end thereof to protrude in the radial direction. Meanwhile, the drive sub 11 at a position corresponding to the position of the spring collet 24 in the axial direction is configured such that the lower radial length of the inner peripheral surface in the axial direction is slightly smaller than the upper radial length thereof. That is, a stepped portion is formed on the inner peripheral surface of the drive sub 11 in the axial direction. This stepped portion is sloped downward. The claw portion of the spring collet 24 can be latched to the stepped portion of the drive sub 11. However, when the flange portion is pressed by the ball valve spring 25, the inner periphery of the claw portion of the spring collet 24 becomes narrow, and the claw portion is thereby unlatched from the stepped portion of the drive sub 11, and the spring collet 24 moves downward. In the state of FIG. 2, the spring collet 24 is sandwiched between the outer tube 10 or the drive sub 11 and the release sleeve 26. In this state, the inner periphery of the claw portion of the spring collet 24 cannot become narrow, the spring collet 24 is latched to the stepped portion of the drive sub 11, and thereby the spring collet 24 cannot move downward. In this case, the spring collet 24 and the seal carrier 23 cannot push down the ball valve 20. Therefore, the ball valve 20 is pushed up by the ball follower 17 and the return spring 18, and the ball valve 20 becomes open.

Figure 3:
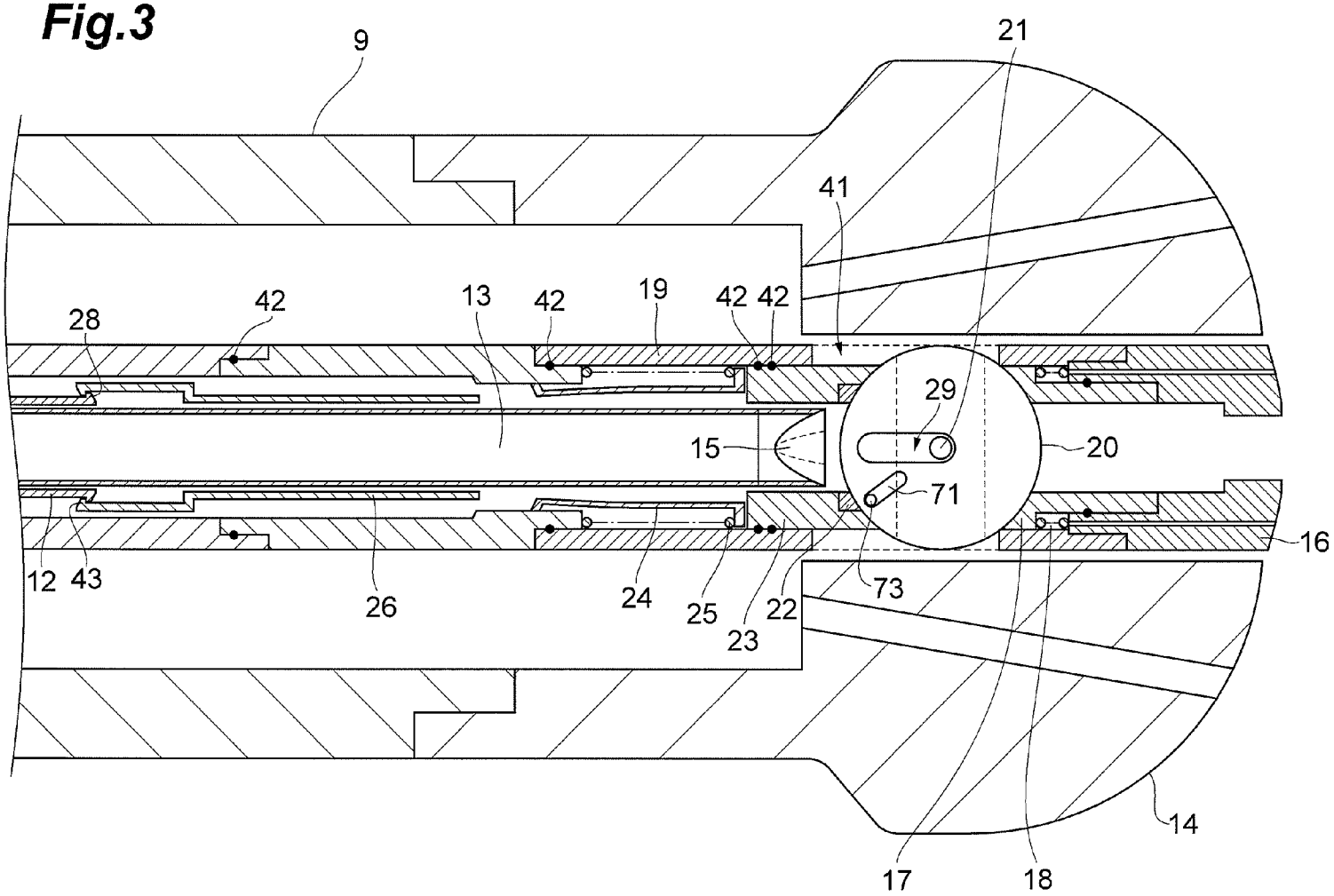
FIG. 3 is a cross-sectional view (2) of a conventional autoclave.

Next, the operation of closing the ball valve 20 from the state shown in FIG. 2 will be described with reference to the cross-sectional view of the front end portion of the autoclave shown in FIG. 3. In the state shown in FIG. 2, if the inner tube 12 and the core liner 13 are pulled up by a wire (not shown), the claw portion 28 of the inner tube 12 and the claw portion 43 of the release sleeve 26 are engaged, and the release sleeve 26 is also pulled up. As the release sleeve 26 is pulled up like this, the release sleeve 26 is unlatched from the spring collet 24. As the release sleeve 26 is unlatched from the spring collet 24, the flange portion 48 of the spring collet 24 is pushed downward by the biasing force of the ball valve spring 25, and the seal carrier 23 and the ball valve seal 22 are pushed downward by the spring collet 24. Accordingly, the ball valve 20 is pushed downward. When the ball valve 20 moves downward, the movement thereof is possible only in the state in which the pivot pin 73 fixed to the inner peripheral surface of the ball valve housing 19 is received in the pivot hole 71 of the ball valve 20. Therefore, the ball valve 20 rotates about a straight line passing the two positions on which the pivot screw 21 is mounted as a rotation axis. Because of this, when the ball valve 20 has moved downward to come into contact with the lower face of the ball valve housing 19 forming the through-holes 41 (the state shown in FIG. 3), the hole through which the fluid of the ball valve 20 flows in and out faces in a direction perpendicular to the axial direction of the seal carrier 23, etc. Therefore, the fluid cannot flow in or flow out between the internal space and the outside. That is, the ball valve 20 rotates as it moves downward, and closes the space between the upper side and the lower side of the ball valve 20. Further, at this time, the space between the seal carrier 23 and the ball valve 20 is sealed by the ball valve seal 22.

The above-mentioned internal space is formed by the outer tube 10, the drive sub 11, each of which has cylindrical shape, an upper portion from the portion at which the ball valve 20 of the ball valve housing 19 is disposed, and the inner peripheral surface of the seal carrier 23, in the section shown in FIG. 2. The spaces between the outer tube 10 and the drive sub 11, between the drive sub 11 and the ball valve housing 19, and between the ball valve housing 19 and the seal carrier 23, are sealed by annular sealing members 42 such as O rings, or the like. Therefore, if the ball valve 20 is closed so that the space between the ball valve 20 and the seal carrier 23 is sealed by the ball valve seal 22, the fluid between the internal space and the outside cannot flow in or flow out, in the section as shown in FIG. 2. The core liner 13, which is a part of the container accommodating the core sampled as described above, comes to be positioned in the internal space. In addition, the internal space is sealed, so that the pressure of the fluid (a liquid) filled in the internal space is maintained. This pressure is the pressure at the time of core sampling, for example. Meanwhile, the above-mentioned member forming the internal space is equivalent to the barrel part in the embodiment of the present invention, and the portion in which the inflow and outflow of the fluid are prevented by the ball valve 20 is an opening portion of the barrel part.

Next, the process procedure from starting the recovery of the core to recovering the core before pressurizing the inside of the autoclave 2' will be described by using FIG. 4. In order to make it clear that symbols do not necessarily correspond to those of the apparatus according to the present invention, an apostrophe will be added to the symbols of the configuration of the present invention in the following description. FIG. 4(A) is a view at the point of time when coring (recovery of core) is under way. In order to recover the core, the upper portion of the core barrel 2' is not sealed, and the lower portion thereof is not sealed either. In addition, the ball valve 20' is open in the state of FIG. 4(A). Since the ball valve 20' is open like this, the core liner 13' in the core barrel 2' penetrates the ball valve 20', and recovers the core that is positioned in the lower end portion of the core barrel 2'.

As the inner tube 12' and the core liner 13' in the autoclave 2' are pulled up by the wire after the core is recovered, the inner tube 12' and the core liner 13' move to the position upward from the ball valve 20', as shown in FIG. 4(B). In addition, as shown in FIG. 4(C), the inner tube 12' that covers the core liner 13' and the outer tube 10' that covers the inner tube 12' are sealed by O rings 42' (corresponding to lip seals of the present embodiment to be described later) at the upper portion of the inner tube 12'. Thereby, the upper side of the core liner 13' is sealed. Here, "sealed" refers to the state in which the fluid cannot flow in or flow out in the vertical direction of the sealed place.

As shown in FIG. 4(C), if the inner tube 12' is further pulled up after the upper side of the inner tube 12' and the outer tube 10' are sealed, then, as shown in FIG. 4(D), the spring collet 24' and the seal carrier 23' push the ball valve 20' to close the ball valve 20' according to the biasing force of the ball valve spring 25' (not shown) with the pulling up operation. The space between the ball valve 20' and the outer tube 10' is sealed by the ball valve seal 22'. Thereby, the lower side of the ball valve 20' is also sealed. Therefore, the fluid cannot flow in or flow out in the vertical direction of the ball valve 20'. Thereby, a space in which the core liner 13' is positioned in the cylindrical outer tube 10' between a seal portion of the inner tube 12' and the outer tube 10' and a seal portion with the ball valve 20' becomes a sealed space. The fluid (the liquid) filled in the sealed space is blocked from the fluid (seawater, mud water) outside of the sealed space, so as to maintain the pressure therein.

Figure 4:
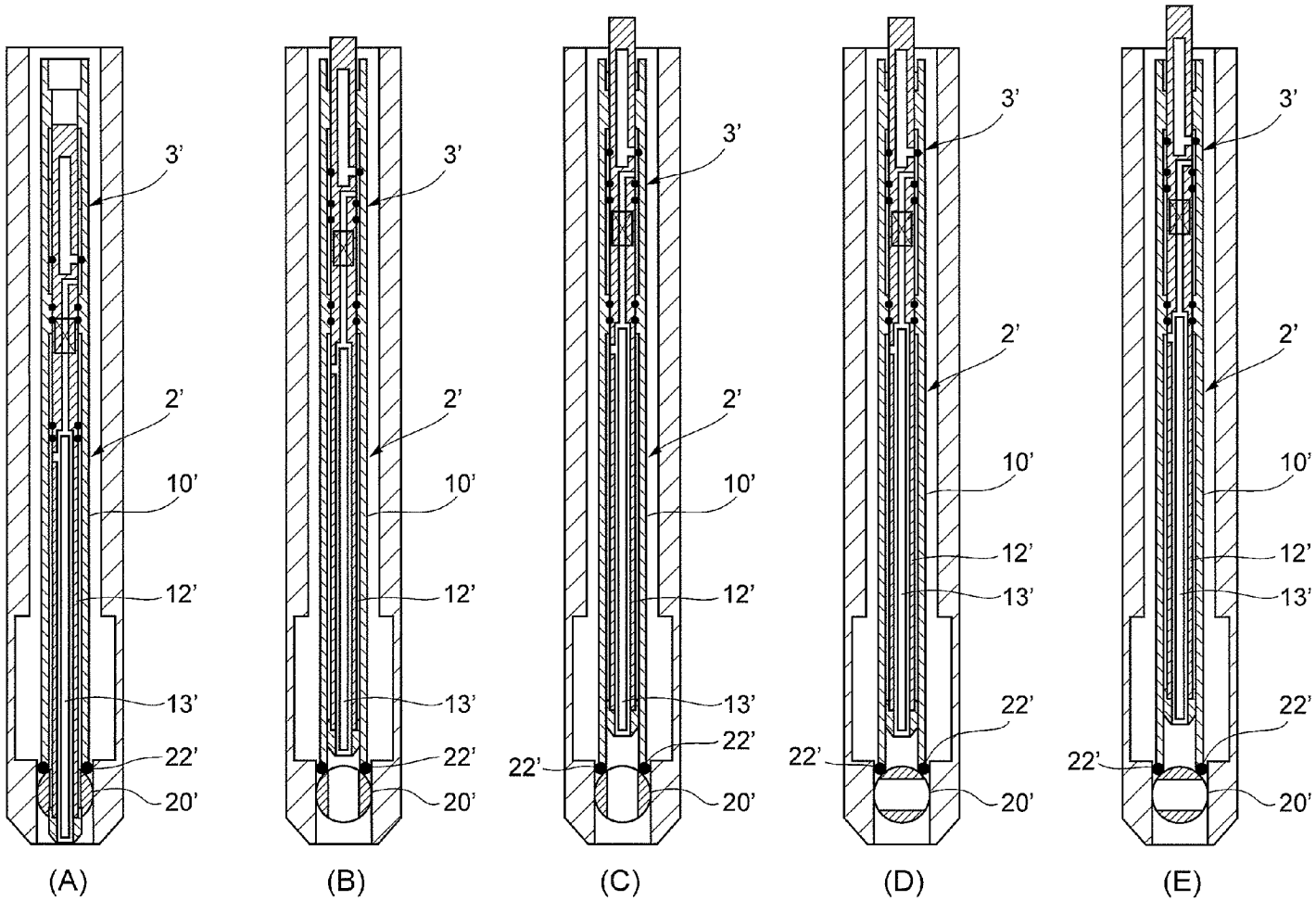
FIG. 4 is a view showing the procedure of an upper sealing.

In addition, as shown in FIG. 4(E), in order to pressurize the inside of the inner tube 12' after the ball valve 20' is closed, pressurized water is supplied into the inner tube 12' from the outer tube 10' in the pressure maintain part 3' to pressurize the inside of the inner tube 12'. When the inner tube 12' and the outer tube 10' are sealed, if the inner tube 12' is pulled further up to pressurize inside of the inner tube 12', the volume in the sealed space increases according to the distance by which it is pulled up. Thereby, the pressure of the fluid in the sealed space decreases, so that the pressure upward from the ball valve 20 of the fluid outside of the sealed space increases compared with the pressure of the fluid in the sealed space. Therefore, it becomes possible to pull up the ball valve 20 and the ball valve 20' is opened. Thereby, the sealed state is not maintained in the conventional autoclave 2', and as a result, there is a risk of the pressure of the fluid in the sealed space not being maintained. Meanwhile, in the description using FIG. 4, the outer tube 10' that forms the internal space (the sealed space) is described as one member for simplification. But actually, it may include a plurality of cylindrical members like the configuration included in the autoclave 2 according to the embodiment of the present invention.

Next, a problem that the ball valve 20 cannot be maintained in the closed state will be described using FIG. 5. Meanwhile, the right side of FIG. 5 becomes the lower side and the left side corresponds to the upper side at the time of drilling. FIG. 5(A) is a view showing the state immediately after the ball valve 20 is closed. The ball follower 17 presses the ball valve 20 from below and the seal carrier 23 presses the ball valve 20 from above through the ball valve seal 22 to close the ball valve 20. However, when the seal carrier 23 merely presses the ball valve 20 from the ball valve seal 22, the pressure tightness (the adherence degree between the ball valve seal 22 and the ball valve 20) is not improved. Although the seal carrier 23 may press the ball valve 20 more strongly from the ball valve seal 22 side to further improve the pressure tightness, this is difficult for the following reason. If the upper side (the sealed portion between the outer tube 10 and the inner tube 12) becomes sealed, the lower side (the sealed portion between the ball valve 20 and the ball valve seal 22) is also sealed (that is, the upper and lower sides are sealed) when the ball valve 20 reaches the end face of the ball valve seal 22. Thereby, the internal volume from the upper side to the lower side is fixed. In order for the seal carrier 23 to press the ball valve 20 more strongly, it is necessary to change the internal volume (to increase the internal volume) of the sealed space. However, because the sealed space is configured as described above, it is difficult to change the internal volume of the sealed space, and thus the seal carrier 23 cannot press the ball valve 20 more strongly. As shown in FIG. 5(A), because the pressure tightness of the ball valve 20 is not increased, if the external pressure is increased higher than the internal pressure in this state, the ball valve 20 may be opened. For example, the ball valve 20 may be unfastened by the vibration due to the pump circulating operation, etc. during the recovery of core.

Figure 5:
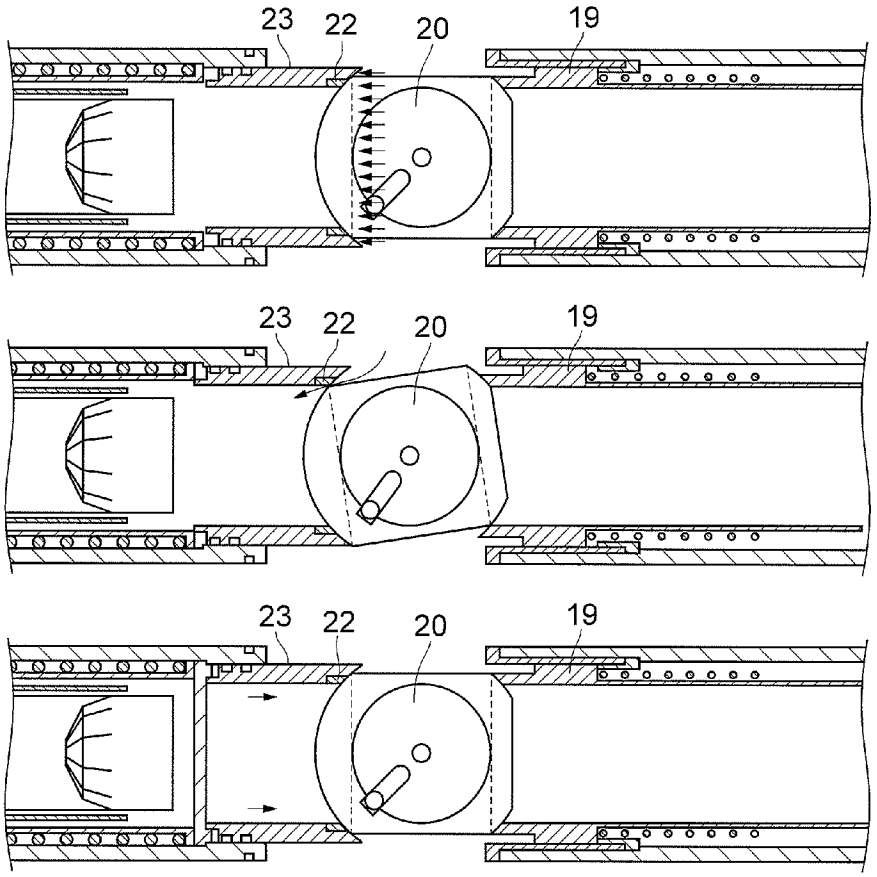
FIG. 5 is a cross-sectional view showing the operation of a conventional ball valve.

Further, when the ball valve 20 is sealed from the end portion of the ball valve seal 22, the ball valve 20 changes from a sealing-started state as shown in FIG. 5(B) to a sealed state as shown in FIG. 5(C). Thereby, in the sealed state, the ball valve 20 moves the distance from the end portion of the ball valve seal 22 until the ball valve 20 is closed, and as a result, the internal space of the seal carrier 23 side is increased by the change of the position of the ball valve seal 22. Therefore, the liquid of the seal carrier 23 side expands, and as a result, the pressure of the seal carrier 23 side decreases. Consequently, the pressure of the ball follower 17 side increases and the ball follower 17 pushes up the ball valve 20, so that the ball valve 20 becomes opened. Therefore, it is difficult to maintain the internal pressure. To solve the problems described in FIGS. 4 and 5, the disclosure of the present embodiment seeks to maintain the pressure of the fluid in the sealed space.

Figure 6:
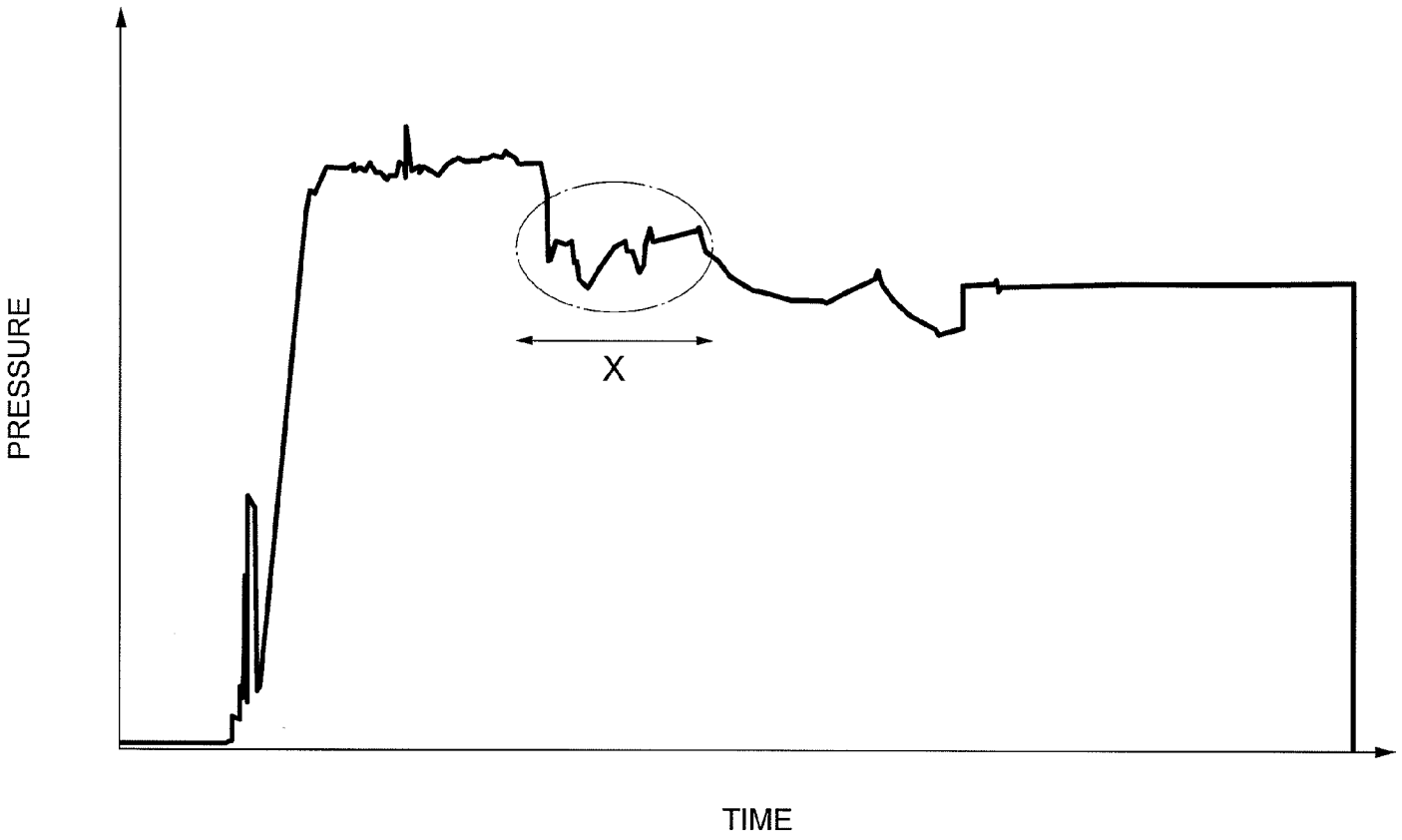
FIG. 6 is a graph showing the pressure fluctuation.

Next, FIG. 6 shows a graph of pressure fluctuation in a series of drilling work. The vertical axis shows the internal (the internal space mentioned above) pressure of the core barrel 1, and the horizontal axis shows the work time. Work refers to moving the core barrel 1 to the seabed, and after recovering the core, pulling it up to ground. FIG. 6 shows that the ball valve 20 is opened or closed again by the pressure change due to the repeated pulling up, as shown in FIG. 5, and thereby the internal pressure of the core barrel 1 is not maintained but fluctuates while the core barrel 1 is being pulled up from the seabed during a period X.

(Upper Side Seal)

Figure 7:
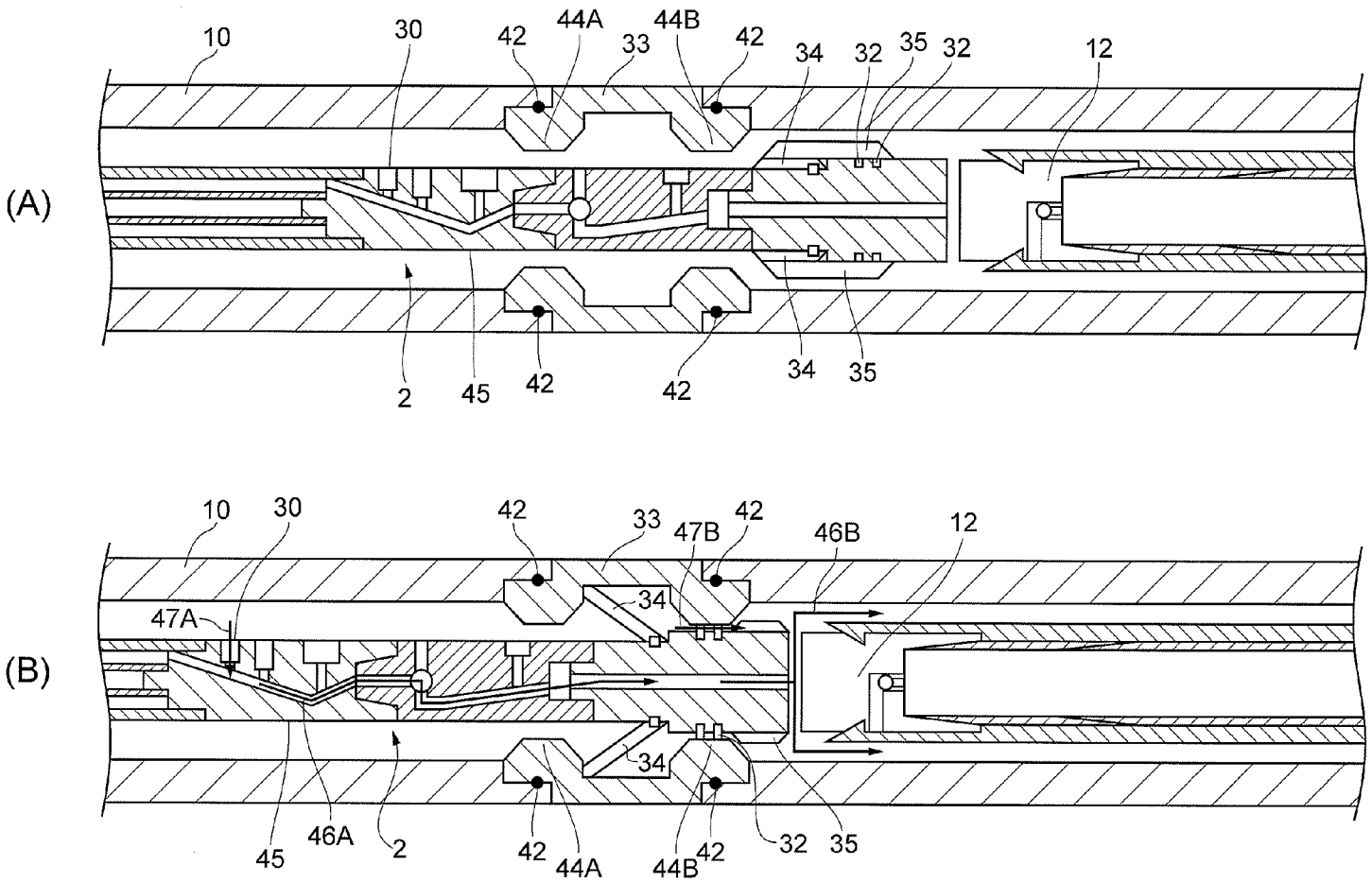
FIG. 7 is a view showing the operation of a top seal.

Next, the seal structure related to the embodiment of the present invention will be described. In the outer tube 10 and the inner tube 12 that are included in the autoclave 2, first, a mechanism that seals the outer tube 10 and the inner tube 12 at the upper portion of the autoclave 2 will be described, and then a mechanism for sealing the lower portion of the autoclave 2 will be described. At the beginning, the operation of sealing the outer tube 10 and the inner tube 12 at the upper portion of the autoclave 2 will be described. Meanwhile, the right side of FIG. 7 is the downward direction.

As shown in FIG. 7(A), the outer tube 10 and a seal sub 33 connected to the outer tube 10 are disposed at the upper portion of the autoclave 2. The seal sub is a cylindrical member, and the space between the outer tube 10 and the seal sub 33 is sealed by O rings 42. Thereby, the outer tube 10 and the seal sub 33 have a cylindrical internal space. This internal space is connected to the internal space of the lower portion of the autoclave 2 described above. In an unsealed state, the inner tube 12 is positioned below the seal sub 33 in the internal space. Here, two convex portions 44A and 44B which protrude in the radially inward direction are formed on the inner peripheral surface of the seal sub 33 in the circumferential direction. Lip seals 32 of annular seal members are mounted on the outer periphery of the inner tube 12. Grooves for disposing the lip seals 32 are formed in the outer periphery of the inner tube 12. A plurality of (two seals in the present embodiment) seals 32 may be disposed in the axial direction. The lip seals 32 are configured to seal the outer peripheral surface of the inner tube 12 and the inner peripheral surface of the seal sub 33. The lip seal 32 is a member which can make fluid flow in from the sealed upper space to the downward space only (one direction) when sealed. A conventional lip seal may be used as the lip seal 32. Further, flared claws 34 are integrally mounted on the outer periphery of the inner tube 12 at the upper side from the portion of the inner tube 12 in which the lip seals 32 are disposed. The flared claws 34 are bar-shaped members and are disposed in the axial direction of the inner tube 12, and the lower end portion thereof is connected to the outer peripheral surface of the inner tube 12. Other end portions of the flared claws 34 that are not connected to the inner tube 12 can be opened upward and outward (in the upward and radial directions). In addition, the lip seals 32 and the flared claws 34 are covered by a release sleeve 35. Meanwhile, the flared claws 34 are covered by the release sleeve 35 in a state in which the claw is closed (not opened in the axial direction of the inner tube 12). The release sleeve 35 is an annular member. If a force is applied to the release sleeve 35 in the axial direction (if pressed in the axial direction), the release sleeve 35 is unlatched from the portion of the lip seal 32 and the flared claw 34 of the inner tube 12.

The inner tube 12 has an accumulator sub 45 formed at the upper portion thereof for receiving the fluid (the pressurized water) from the pressure maintain part 3. The accumulator sub 45 is connected to the top end portion of the inner tube 12. The accumulator sub 45 has a flow passage 46A formed therein, and is connected inflowably to the flow passage 46B formed in the inner tube 12. As the fluid flows into a sealed internal space from the pressure maintain part 3 through the flow passages 46A and 46B, the pressure of the internal space can be maintained. A check valve 30 that can make the fluid flow in only one direction is disposed in the accumulator sub 45. The inflow destination of the check valve 30 becomes the flow passage 46A, and the inflow source is formed in a place which becomes the position of the upper side of the sealed position (the outside of the sealed internal space) when sealed by the lip seals 32. A conventional check valve may be used as the check valve 30.

When the accumulator sub 45 and the inner tube 12 are pulled up by the wire, the release sleeve 35 of the inner tube 12 comes into contact with the convex portion 44A of the seal sub 33, and the release sleeve 35 moves downward, as shown in FIG. 7(B). Thereby, the flared claw 34 is opened upward and outward to come into contact with the convex portion 44B of the seal sub 33. In addition, the lip seals 32 are positioned on the convex portion 44A of the seal sub 33, so that the convex portion 44A of the seal sub 33 and the outer peripheral surface of the inner tube 12 are sealed by the lip seal 32. Thereby, the upper portion of the inner tube 12 is sealed and an internal space is formed therein.

In the portion shown in FIG. 7, the internal space is formed by the portion downward from the seal sub 33 of the respectively cylindrical outer tube 10 and the inner peripheral surface of the seal sub 33. The portion downward from the sealed portion of the inner tube 12 and the core liner 13 included in the container that accommodates the core are positioned in the internal space. As described above, the inner peripheral surface of the seal sub 33 and the outer peripheral surface of the inner tube 12 are sealed so that the fluid from the outside (the portion upward from the sealed portion) is prevented from flowing in or flowing out.

However, the fluid can flow in the inflow direction 47A of the check valve 30 or the inflow direction 47B of the lip seal 32 (the direction facing the internal space from outside). Therefore, after the upper portion of the inner tube 12 is sealed, the inner tube 12 is moved further upward, and even when the volume of the internal space increases, the fluid flows into the internal space from the outside according to the increase in volume from the check valve 30 and the lip seals 32. Thereby, it is possible to maintain the pressure of the internal space in a sealed state, and as the volume of the sealed internal space increases, it is possible to prevent the seal state (especially the seal state of the lower portion of the autoclave 2) from being unstable.

(First Locking Mechanism for Locking Sealed State of Ball Valve)

Next, a mechanism for locking the sealed state from below the autoclave 2 will be described. Specifically, the mechanism for locking the state in which the space between the ball valve 20 and the seal carrier 23 is sealed by the ball valve seal 22 will be described. First, a first locking mechanism for locking the sealed state of the ball valve will be described.

Figure 8:
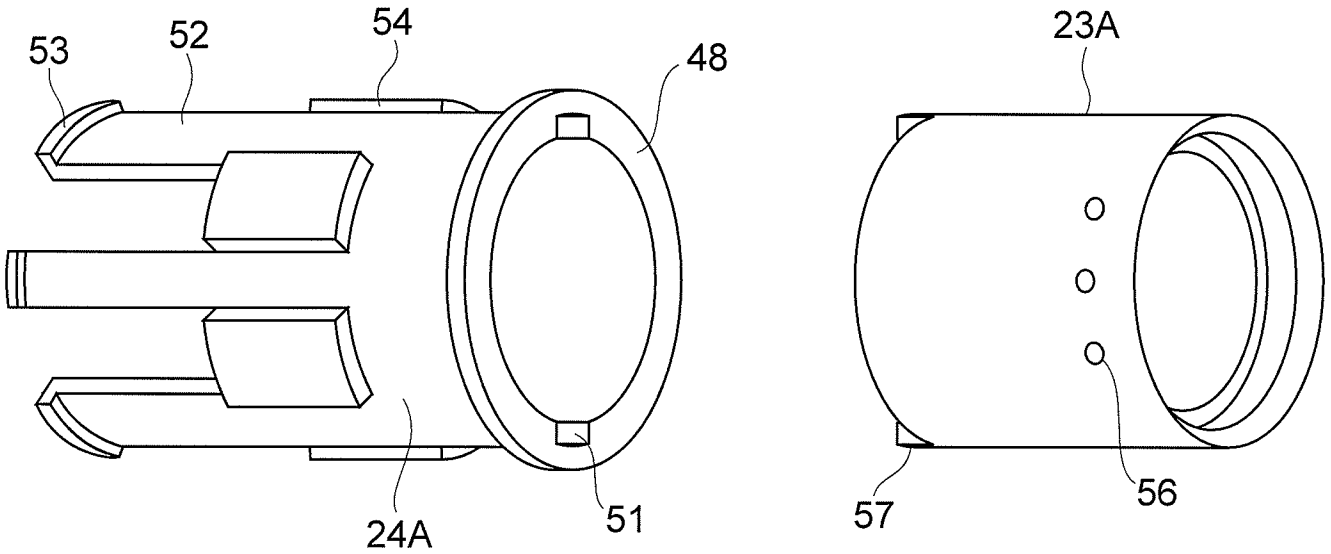
FIG. 8 is an enlarged perspective view of a spring collet, etc.

The first locking mechanism of the ball valve includes a groove formed in the drive sub 11. As the claw formed in the spring collet 24A is fitted into the groove of the drive sub 11, the spring collet 24A is fixed so as to lock the ball valve 20. FIG. 8 shows the spring collet 24A and the seal carrier 23A. As shown in FIG. 8, a plurality of connecting slots 51, which are grooves for connecting to the seal carrier 23, are formed in the inner peripheral side of the flange portion 48 of the spring collet 24A, which is a face in contact with the seal carrier 23. The connecting slots 51 are the concave portions formed on the inner peripheral side of the flange portion 48. The tip portion of the spring collet 24A on the side opposite to the ball valve 20 is provided with a long leg part 52 formed in a slit shape, that is, extending in the axial direction at a predetermined interval (for example, every 30°) in the circumferential direction. One end of the long leg part 52 is provided with a claw portion 53 which protrudes outward, and a side at which the long leg part 52 is not formed (the portion inserted into the position where the long leg part 52 is in the axial direction) is provided with a claw portion 54 which protrudes outward in the circumferential direction toward the tip side of the long leg part 52. That is, the claw portion 53 and the claw portion 54 of the long leg part 52 are formed alternately.

The claw portion 54 has a sufficient length in the axial direction compared with the claw portion 53. Further, the claw portion 54 has an end face that can reach another member on the side opposite to the ball valve 20. Further, the length from the center axis of the spring collet 24A to the tip face in the radial direction of the claw portion 53 and the claw portion 54 is sufficient that the spring collet 24A can move in the axial direction in the drive sub 11, and the same as the size of the inner peripheral radius of the drive sub 11.

The seal carrier 23A has concave portions 56 formed at a side of the ball valve seal 22 on the outer peripheral surface thereof, and connecting protrusions 57 which protrude in the circumferential direction on the tip portion of the seal carrier 23A. The connecting protrusions 57 are convex portions protruding in the axial direction. By fitting the connecting protrusions 57 of the seal carrier 23A into the connecting slots 51 of the spring collet 24A, the spring collet 24A and the seal carrier 23A are connected to each other. If a rotary pin is rotated in the circumferential direction with the bar-shaped rotary pin inserted into the concave portion 56, the circumferential force applied to the rotary pin is transmitted to the seal carrier 23A through the concave portion 56, so the seal carrier 23A rotates in the circumferential direction. If the seal carrier 23 rotates in the circumferential direction, the spring collet 24A rotates in the circumferential direction accordingly. Thus, when the ball valve 20 is closed, if the seal carrier 23A is rotated in the circumferential direction by the rotary pin fitted into the concave portion 56 of the seal carrier 23A positioned in the through-holes 41 of the side of the ball valve housing 19, the spring collet 24A can also be rotated.

Figure 9:
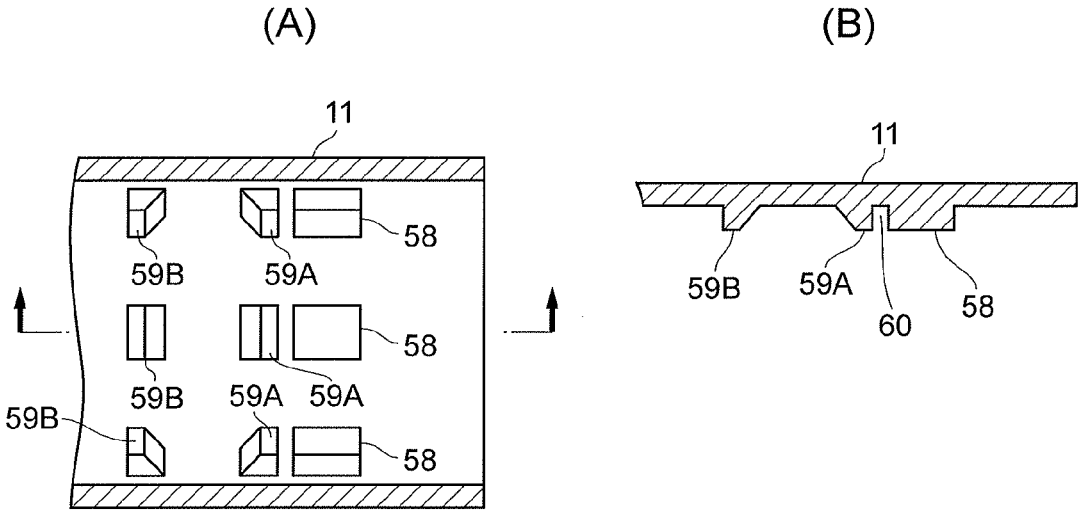
FIG. 9 is a cross-sectional view of a groove.

FIG. 9 shows the groove formed in the drive sub 11. FIG. 9(A) is a view of the inner peripheral surface of the drive sub 11 as seen from the inside, and FIG. 9(B) is a cross-sectional view at the cross section along the center axis of the drive sub 11. As shown in FIG. 9(A), the groove provided in the drive sub 11 is formed by disposing a convex portion 58 on the inner peripheral surface of the drive sub 11 and a convex portion 59A upward from the convex portion 58. The groove is formed by the upper face of the convex portion 58, the lower face of the convex portion 59A, and the inner peripheral surface of the drive sub 11 between the convex portion 58 and the convex portion 59A. The upper face of the convex portion 59A is formed with a slope that increases toward the bottom. The groove is formed on the inner peripheral surface in the circumferential direction at a predetermined interval (for example, every 30°), and no groove is formed on the other inner peripheral surface of the drive sub 11. Further, as shown in FIGS. 9(A) and 9(B), the convex portion 59B is formed on the inner peripheral surface of the drive sub upward from the convex portion 59A. The lower side of the convex portion 59B has a slope that increases toward the top. The upper face of the convex portion 59B serves as a stepped portion of the drive sub 11 on which the claw portion 53 of the spring collet 24 is latched (pressed to the release sleeve 26).

In addition, the length L1 from the convex portion 58 to the convex portion 59A is formed shorter than the length L2 from the claw portion 53 to the claw portion 54. In addition, the position of the groove of the drive sub 11 in the axial direction is determined based on the position of the claw portion 53 of the spring collet 24A in the state in which the ball valve 20 and the ball valve seal 22 are sealed. Specifically, when the claw portion 53 of the spring collet 24A is fitted into the groove 60, the groove 60 is formed at the position at which the ball valve seal 22 reliably seals the ball valve 20 with the spring collet 24A and the seal carrier 23A. Further, the length in the axial direction of the claw portion 54 is formed shorter than the length L3 from the convex portion 59A to the convex portion 59B.

Figure 10:
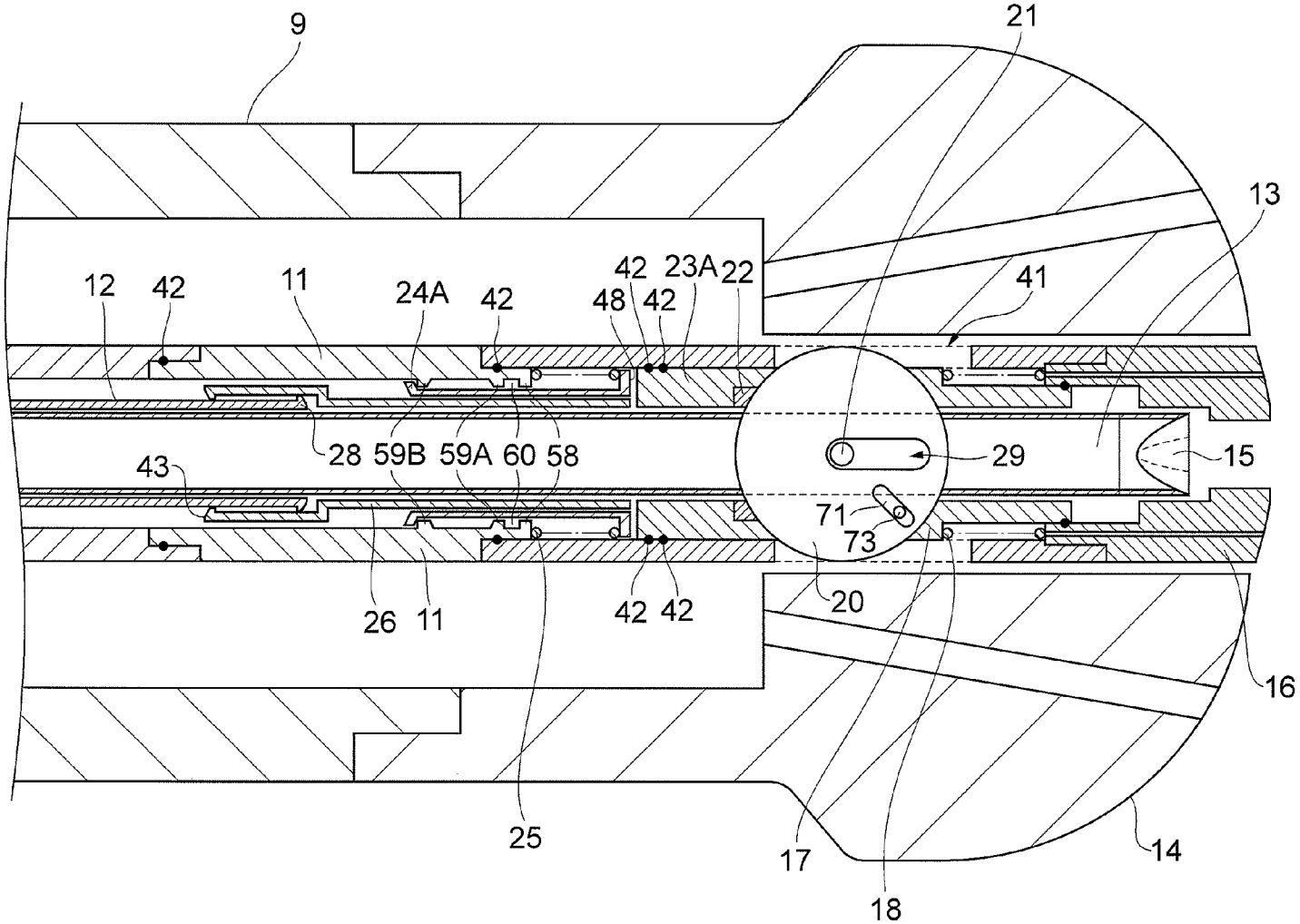
FIG. 10 is a view showing a state in which a ball valve of a first ball valve locking method is opened.

The operation of locking the sealed state of the ball valve 20 will be described using FIGS. 10 and 11. As shown in FIG. 10, the ball valve 20 is opened at the time of core sampling. The claw portion 53 of the spring collet 24 is positioned upward from the groove. The spring collet 24 is sandwiched between the drive sub 11 and the release sleeve 26 so that it is unable to move downward. Next, when the inner tube 12 is pulled up by the wire, the inner tube 12 is pulled up as shown in FIG. 11, and the claw portion 43 of the release sleeve 26 is latched to the claw portion 28 of the inner tube 12, so that the release sleeve 26 is pulled up.

Figure 11:
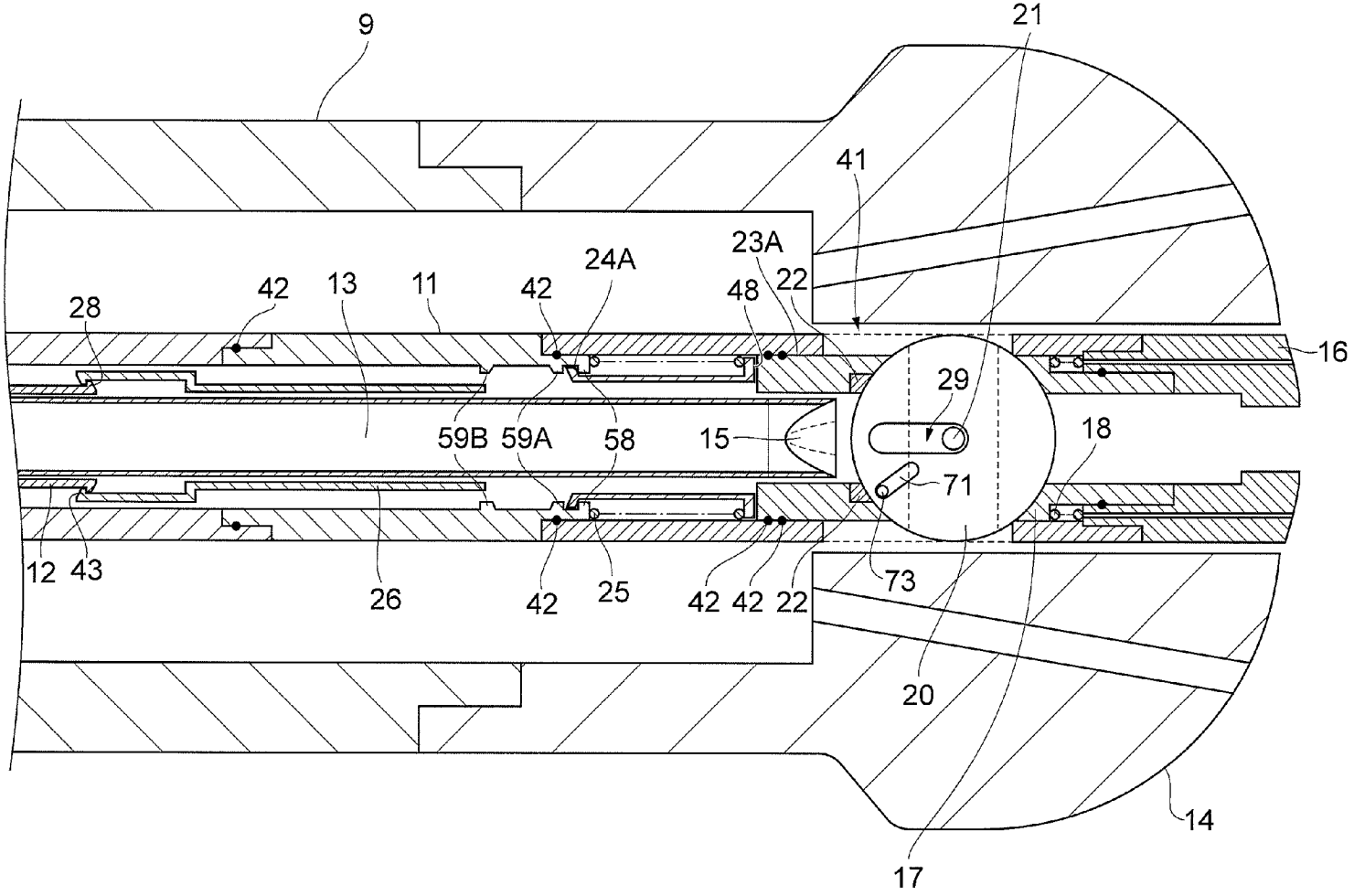
FIG. 11 is a view showing a state in which a ball valve of a first ball valve locking method is closed.

When the release sleeve 26 is pulled up, there is no member that prevents the spring collet 24A from moving downward due to the release sleeve 26 being unlatched therefrom, as shown in FIG. 11, so that the ball valve spring 25 pushes the flange portion 48 of the spring collet 24A downward by the biasing force, and the spring collet 24A pushes the seal carrier 23 and the ball valve seal 22 downward, thereby pushing the ball valve 20 downward. In addition, the claw portion 53 of the long leg part 52 of the spring collet 24A is fitted into the groove 60 of the drive sub 11 beyond the convex portion 59B and the convex portion 59A to fix the position of the spring collet 24A in the axial direction.

As the spring collet 24A presses the seal carrier 23A, the ball valve seal 22 presses the ball valve 20. Thereby, the ball valve 20 is sealed. Further, the ball valve 20 is supported by the ball follower 17, etc. from the side opposite to a seal direction. Further, since the claw portion 54 of the long leg part 52 of the spring collet 24A is fitted tightly in the groove 60 of the drive sub 11, the ball valve 20 is locked. That is, the autoclave 2 becomes sealed.

(Releasing Locked State of Ball Valve)

A method of the ball valve 20 returning from the sealed state to the original state (the state of FIG. 10) as mentioned above will be described. As a premise, it is assumed that the user manipulates the seal carrier 23A after removing the bit 14 when the ball valve 20 is sealed. As shown in FIG. 8, the long leg part 52 is formed at a predetermined interval, and as shown in FIG. 9, the groove 60 of the drive sub 11 is also formed at a predetermined interval.

Here, as the rotary pin of the seal carrier 23A is latched to the concave portion 56 to rotate the seal carrier 23A in the circumferential direction, the spring collet 24A also rotates, and the claw portion 53 of the long leg part 52 is unlatched from the groove 60. In this state, the claw portion 53 is not positioned in the groove 60 in the axial direction.

In such a state, since the claw portion 53 is not positioned in the groove 60 in the axial direction, it is possible to press the seal carrier 23A upward. In addition, if the seal carrier 23A is pushed upward, the lower face of the claw portion 54 of the spring collet 24A comes into contact with the convex portion 58. In this state, by rotating the seal carrier 23A further in the circumferential direction, the claw portion 54 is unlatched from the convex portion 58. In this state, the claw portion 54 is not positioned in the groove 60 in the axial direction. In addition, the claw portion 53 of the long leg part 52 is positioned between the convex portion 59A and the convex portion 59B.

In this state, since the claw portion 54 is not positioned in the groove 60 in the axial direction, it is possible to press the seal carrier 23 upward. Further, if the seal carrier 23A is pushed upward, the claw portion 53 of the long leg part 52 moves from the position between the groove 60 on the inner peripheral surface of the drive sub 11 and the convex portion 59B to a position beyond the convex portion 59B along the inner peripheral surface. In this state, by mounting the release sleeve 26 again, the ball valve 20 returns to the state before sealing. That is, the ball valve 20 returns to the state shown in FIG. 10.

(Second Locking Mechanism for Locking Sealed State of the Ball Valve)

Next, a second locking mechanism for locking the sealed state of the ball valve will be described. In the second ball valve locking mechanism, a ring member 61 having an outward openable slit portion is mounted on the seal carrier 23B. When the ball valve 20 is closed, the ball valve housing 19 and the seal carrier 23B are locked in the state in which the slit portion is expanded, and thereby the ball valve 20 is locked.

Figure 12:
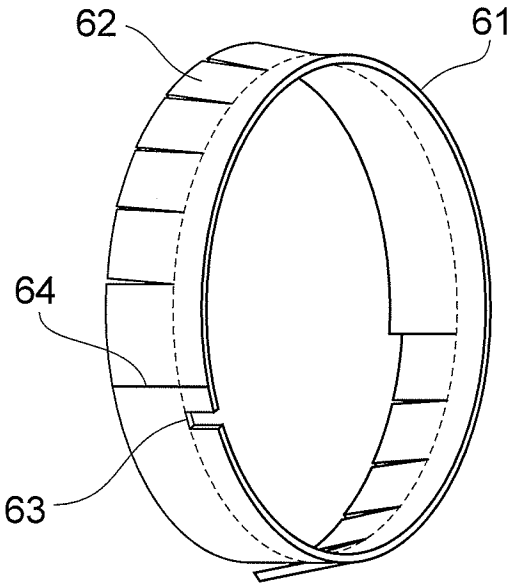
FIG. 12 is a view showing the configuration of a second locking method of the ball valve.
Figure 12:
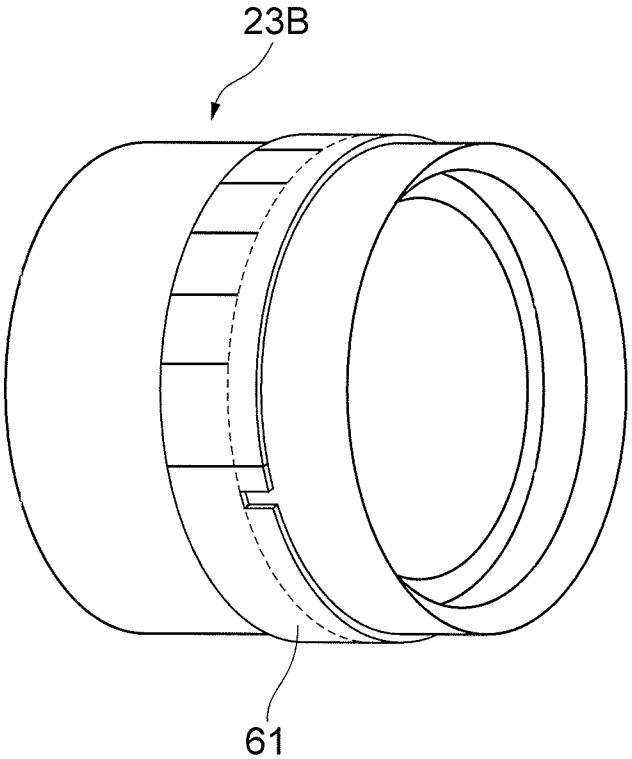

FIG. 12 shows an annular ring member 61 and a seal carrier 23B with the ring member 61 mounted thereon. The outer periphery of the lower side (toward the ball valve seal 22) of the seal carrier 23B is smaller than the outer periphery of the upper side (toward the spring collet 24). A groove is formed on the outer periphery of the seal carrier 23B in the circumferential direction so that the ring member 61 can be fitted therein. The length of this groove is about the same as the length of the ring member 61 in the axial direction. When the ring member 61 is fitted into the groove formed on the seal carrier 23B, the diameter of the outer periphery of the ring member 61 is about the same as the seal carrier 23B. Therefore, it is possible to wrap the ring member 61 on the seal carrier 23B due to the difference between the lower outer periphery and the upper outer periphery in the seal carrier 23B.

FIG. 12(A) is a perspective view of the ring member 61. The ring member 61 is a metal member, for example. The ring member 61 has outward openable slits 62, a positioning dock 63, and a cut opening portion 64. The outward openable slit 62 is a slit portion cut in the axial direction from the upper end face. The outward openable slit 62 is bent in a radially outward direction, and an elastic force returning outward acts when it returns in the radially inward direction (to the unbent state). The positioning dock 63 becomes a mark for positioning the mounting place when mounting on the seal carrier 23B, and is a concave notch formed on the lower end face thereof. Also, a protrusion is formed (remains) at the position corresponding to the notch (to be fitted into the notch) in the groove of the outer periphery of the seal carrier 23B. If the protrusion formed on the seal carrier 23B is fitted into the notch, the position at which the ring member 61 is mounted on the seal carrier 23B is determined. The cut opening portion 64 is a place that is cut in the axial direction for mounting on the seal carrier 23B. Meanwhile the outward openable slit 62 corresponds to a blade portion.

FIG. 12(B) is a perspective view showing a state in which the ring member 61 is wound on the seal carrier 23B. The ring member 61 is mounted on the outer peripheral surface of the seal carrier 23B so as to be wound. The ring member 61 is wound at the position at which the outward openable slit 62 can come in contact with the upper surface of the ball valve housing 19 forming the through-holes 41 when the ball valve 20 is sealed.

Figure 13:
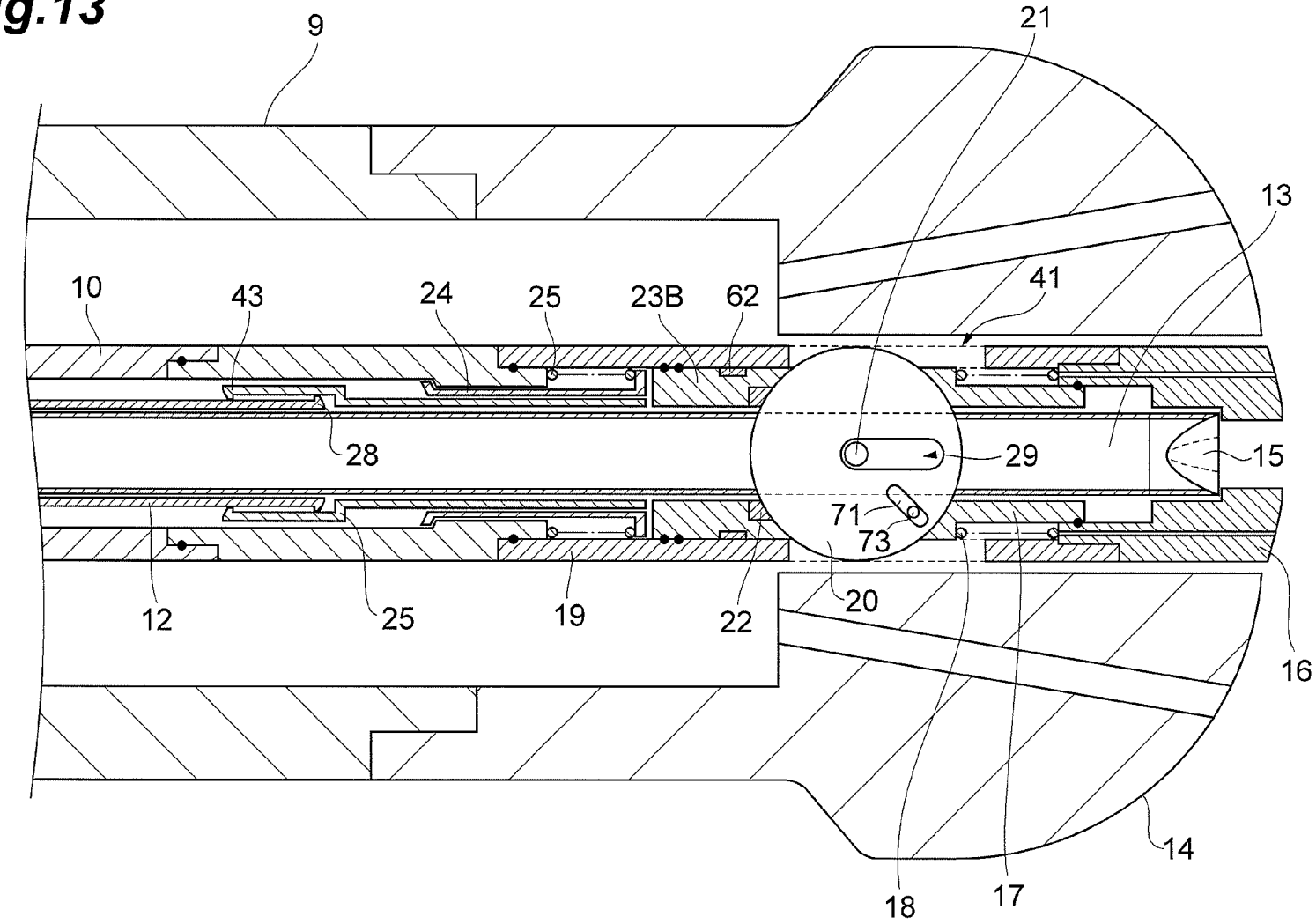
FIG. 13 is a view showing a state in which a ball valve of a second ball valve locking method is opened.

The operation for locking the sealed state of the ball valve 20 will be described using FIGS. 13 and 14. As shown in FIG. 13, the ball valve 20 is opened at the time of core sampling. The spring collet 24 is sandwiched between the drive sub 11 and the release sleeve 26 and is unable to move downward. Further, the seal carrier 23B is accommodated in the ball valve housing 19, and thereby the outward openable slit 62 is in a closed state. Next, when the inner tube 12 is pulled up by the wire, the claw portion 28 of the inner tube 12 and the claw portion 43 of the release sleeve 26 are engaged with each other, so that the release sleeve 26 is also pulled up.

Figure 14:
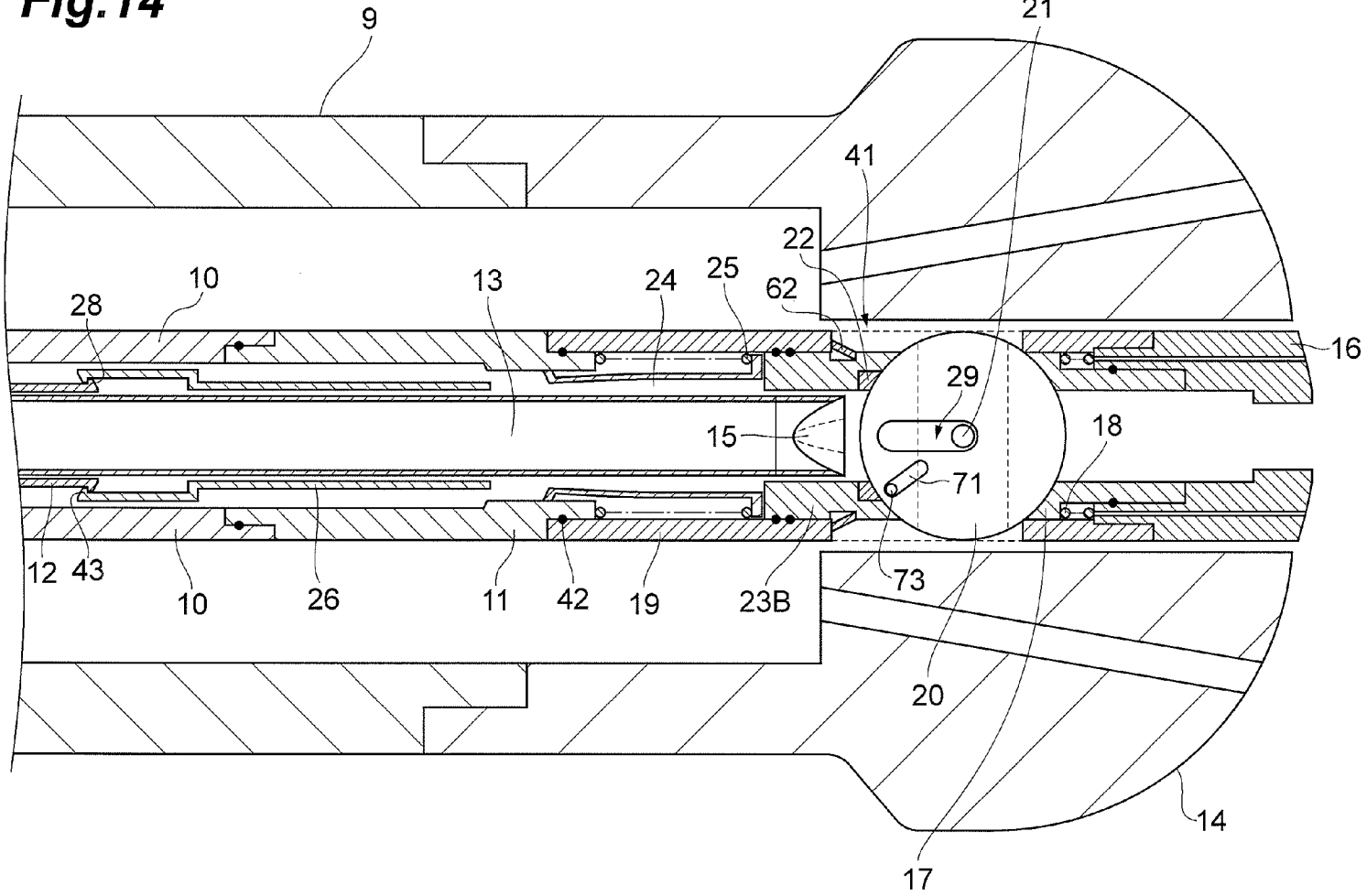
FIG. 14 is a view showing a state in which a ball valve of a second ball valve locking method is closed.

When the release sleeve 26 is pulled up, there is no member that prevents the spring collet 24 from moving downward due to the release sleeve 26 being unlatched therefrom, as shown in FIG. 14, so that the ball valve spring 25 pushes the flange portion 48 of the spring collet 24 downward by the biasing force, the spring collet 24 pushes the seal carrier 23B and the ball valve seal 22 downward, and the ball valve 20 is thereby pushed downward.

If the seal carrier 23B is positioned in the through-holes 41 of the side of the ball valve housing 19 by pushing the ball valve 20 downward, the pressure applied to the ring member 61 in the radially inward direction from the inner peripheral surface of the ball valve housing 19 disappears. Because of this, the outward openable slit 62 of the ring member 61 mounted on the seal carrier 23B is opened by elastic action, and the outward openable slit 62 comes into contact with (abuts) the upper surface of the ball valve housing 19 forming the through-holes 41 on the side. As the seal carrier 23B presses the ball valve seal 22 like this, the ball valve 20 is sealed. In addition, the ball valve 20 is supported by the ball follower 17, etc. on the side opposite to the seal direction. Further, as the outward openable slit 62 of the ring member 61 mounted on the seal carrier 23B is opened outward, and the outward openable slit 62 comes into contact with the upper face of the outward openable slit 62 and the ball valve housing 19 forming the through-holes 41, the seal carrier 23B becomes unable to return to the upper side. Therefore, the position of the seal carrier 23B is fixed. Thereby, the ball valve 20 is locked. That is, the autoclave 2 becomes sealed. Meanwhile, the upper surface of the ball valve housing 19 defining the through-holes 41 corresponds to a blade supporting part.

(Third Locking Mechanism for Locking Sealed State of Ball Valve)

Next, a third locking mechanism for locking the sealed state of the ball valve will be described. The third locking mechanism includes a deep groove formed by an end portion on the side away from the position at which the pivot screw 21 is mounted, in a pivot hole formed on the side of the ball valve 20A, and a pivot pin fitted into the deep groove so as to lock the ball valve 20A when the ball valve 20A is closed.

Figure 15:
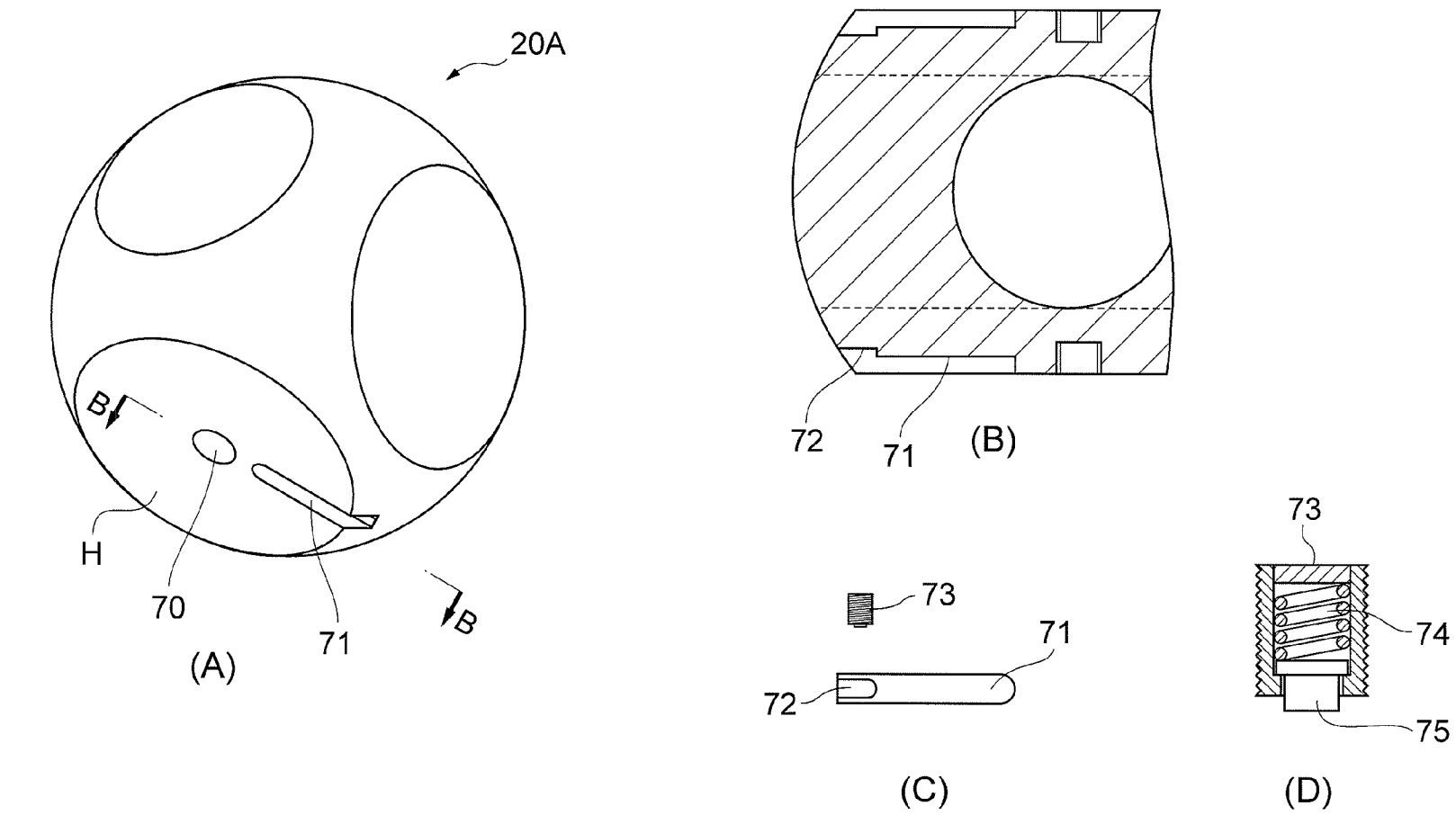
FIG. 15 is a view showing the configuration of a third locking method of the ball valve.

FIG. 15 shows the ball valve 20A. FIG. 15(A) is a perspective view of the ball valve 20A. The ball valve 20A has planes H formed on both sides thereof, and is perpendicular to a rotary axis L2 which is an axis perpendicular to a center axis L1 (an axis of the hole through which the fluid passes) of a sphere. The plane H is a circular plane, and the plane H has a screw hole 70 for mounting the pivot screw 21 at the center position and a pivot hole 71, which extends in the radial direction from the position slightly away from the center position and into which a pin is operatively fitted.

Next, FIG. 15(B) is a cross-sectional view in which the ball valve 20A shown in FIG. 15(A) is cut in the B-B direction. As shown in FIG. 15(B), a deeper groove 72 is formed at the position (the end portion on the side away from the center position) of the outer periphery of the ball valve 20A in the pivot hole 71.

FIG. 15(C) is a top view of the pivot holes 71 and 72, and is a side view of a pivot pin 73 moving in the pivot holes 71 and 72. The pivot pin 73 is a bar-shaped member and has a thread formed on an outer peripheral surface thereof. One end of the pivot pins 73 is mounted in the screw hole formed on both sides of the ball valve housing 19, and the other end of the pivot pins 73 is mounted in the pivot hole 71 of the ball valve 20A. When the ball valve 20A is opened, the pivot pin 73 is positioned in a place away from the center of the ball valve 20A in the pivot hole 71 (but not the position of the deep groove 72). As the ball valve 20A moves downward in an opened state, the position of the pivot pin 73 is moved toward the center of the ball valve 20A in the pivot hole 71 once, and then to the groove 72 from near the center of thereof.

FIG. 15(D) shows a cross-sectional view of the pivot pin 73. The pivot pin 73 has a spring 74 inside the pivot pin 73, and a tip pin 75 at the tip of the pivot pin 73. The spring 74 is in contact with the tip pin 75, and is configured such that the spring 74 can push the tip pin 75 by the biasing force. When the pivot pin 73 is positioned in the pivot hole 71, the pivot hole 71 becomes a shallow groove, and the tip pin 75 is thereby contained in the body. In addition, when the pivot pin 73 is positioned in the groove 72, the groove 72 becomes deeper than the pivot hole 71, and thus the tip pin 75 is pushed by the spring 74, and the tip pin 75 is fitted into the groove 72. Therefore, the pivot pin 73 is fixed. When the pivot pin 73 is positioned at a fixed position, the ball valve 20A is closed and the ball valve 20A can maintain the closed state.

Three types of mechanisms for locking the sealed state in the lower portion of the autoclave 2 have been described above. However, any one of them may be adopted, or all may be adopted.

Figure 16:
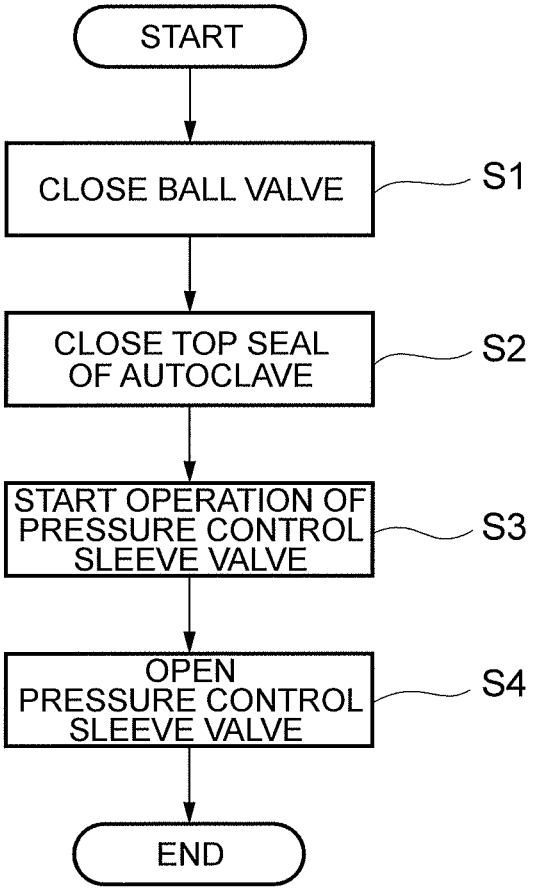
FIG. 16 is a procedure diagram showing the procedure of sealing an autoclave.

Next, the process procedure of sampling the core, forming a sealed space including the core liner 13 constituting the container of the core, and pressurizing will be described using FIG. 16. First, the core liner 13 is pulled up by the wire to the position above the ball valve 20 in the outer tube 10, and the inner tube 12 is pulled up. Thereby, the ball valve 20 is closed (S1). At this time, the space between the ball valve 20 and the seal carrier 23 is sealed by the ball valve seal 22, and the sealed state is fixed by any one of the first to third locking mechanisms.

Next, the inner tube 12 is pulled up further in the outer tube 10, and the space between the outer peripheral surface of the inner tube 12 and the inner peripheral surface of the seal sub 33 is sealed (S2). Once sealed, the internal space in which the container including the core liner 13 is positioned becomes a sealed space, as described above. When the space between the outer peripheral surface of the inner tube 12 and the inner peripheral surface of the seal sub 33 is sealed, and if the inner tube 12 is pulled further upward after being sealed, the volume of the sealed space increases. At this time, the fluid from the lip seal 32 and the check valve 30 flows into the inside from the outside of the sealed space according to the increase in volume. Further, since the sealed state in the lower portion of the autoclave is fixed as described above, improper inflow and outflow of fluid of the outside and inside of the sealed space does not occur therein. Therefore, even when the volume of the sealed space is changed due to the movement of the inner tube 12, it is possible to maintain the pressure therein.

Next, preparation for a pressurizing process by the pressure control part 3 is started (step S3), and the inside of the sealed space is pressurized by the pressure control part 3 (step S4). Even if the volume of sealed space is changed due to the movement of the inner tube 12, it is possible to maintain the pressure therein.

Further, control of the pressure according to the volume of the sealed space by the pressure control part 3 (accumulator) can be also considered. In this case, it is necessary to precisely manage the control timing. According to the present embodiment, even when the member is pulled in the outer tube 10 in the conventional manner, it is possible to maintain the pressure therein.

(Container Transfer Apparatus)

Figure 17:
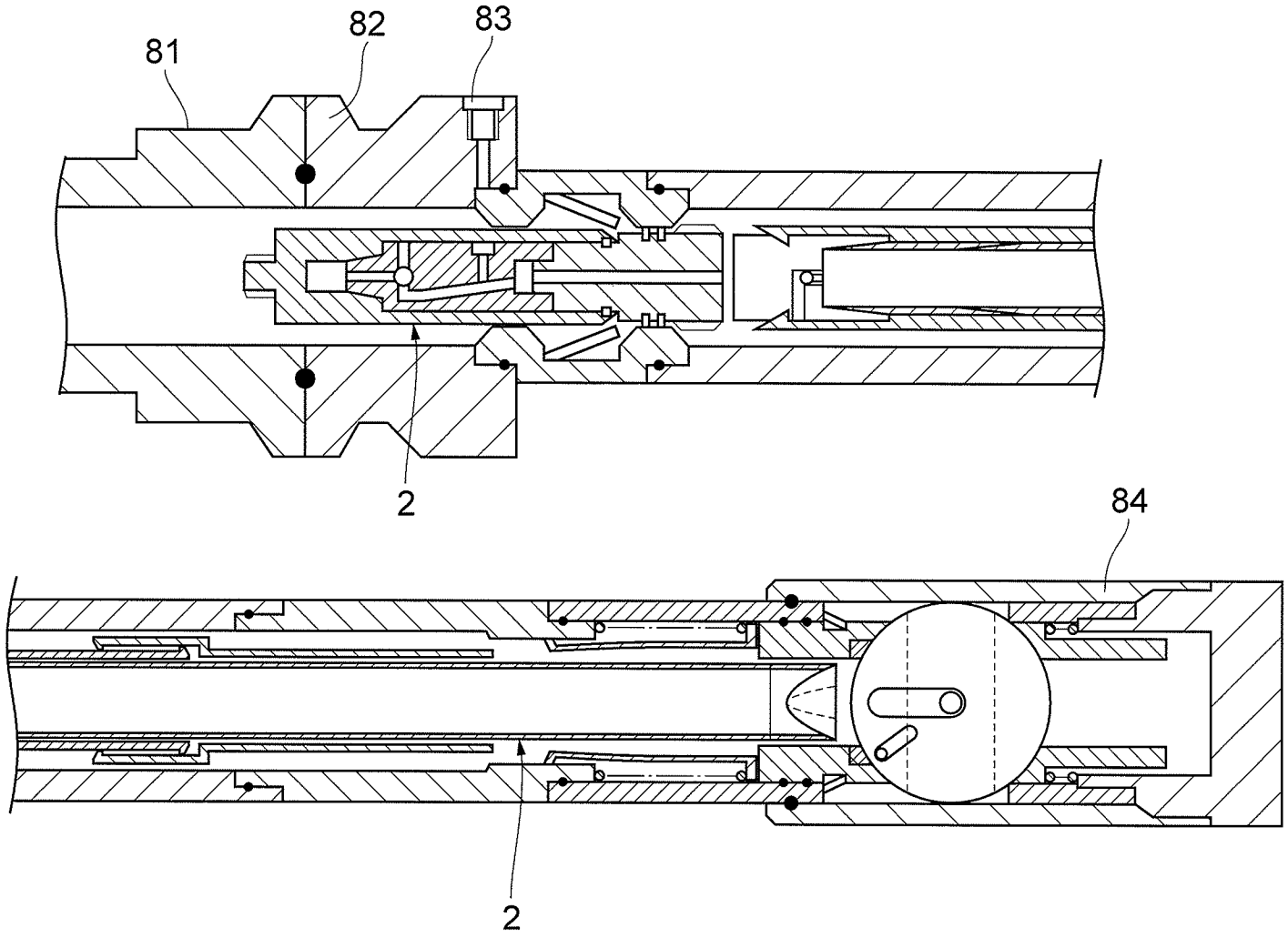
FIG. 17 is a cross-sectional view when the autoclave is capped for transfer.

Next, a container transfer apparatus 90, which is a device for receiving a container including the core liner 13 provided in the autoclave 2 therein, in order to transfer the container to another device (for example, a device for analyzing the core), will be described. Before describing the container transfer apparatus 90, a method of disposing the autoclave 2 in the container transfer apparatus 90 will be described. First, after the pull-up unit 4 and the pressure control part 3 are removed, a cylindrical moving clamp head 82, which is a clamp head for the autoclave 2 side that can flow the fluid into the autoclave 2 shown in FIG. 17(A), is mounted on the upper portion of the autoclave 2, and the moving clamp head 82 is mounted on the cylindrical clamp head 81 which is a clamp head mounted on the container transfer apparatus 90. A space is formed by the inner peripheral surface of the clamp head 81, the inner peripheral surface of the moving clamp head 82, and the autoclave 2 including the container provided with the core liner 13. Further, the space is in contact with the lip seal 32 and the check valve 30 (or at least one). The moving clamp head 82 has an inlet 83, and if the fluid is flowing in the space through the inlet 83, the space can be filled with the fluid according to the fluid of the sealed space of the autoclave 2 (for example, a fluid of equal pressure). Thereby, it is possible to flow the fluid into the sealed space of the autoclave 2 through the lip seal 32 and the check valve 30 even when pulling out the container provided with the core liner 13 from the outer tube 10 and the drive sub 11 forming the sealed space, that is, even when the volume of the sealed space increases. Therefore, it is possible to constantly maintain the pressure of the fluid in the sealed space of the autoclave 2. In addition, the moving bottom cap 84 is mounted on the lower portion of the autoclave 2 shown in FIG. 17(B). Meanwhile, the moving bottom cap 84 is mounted in a state in which the cutting shoe 16 is removed.

Figure 18:
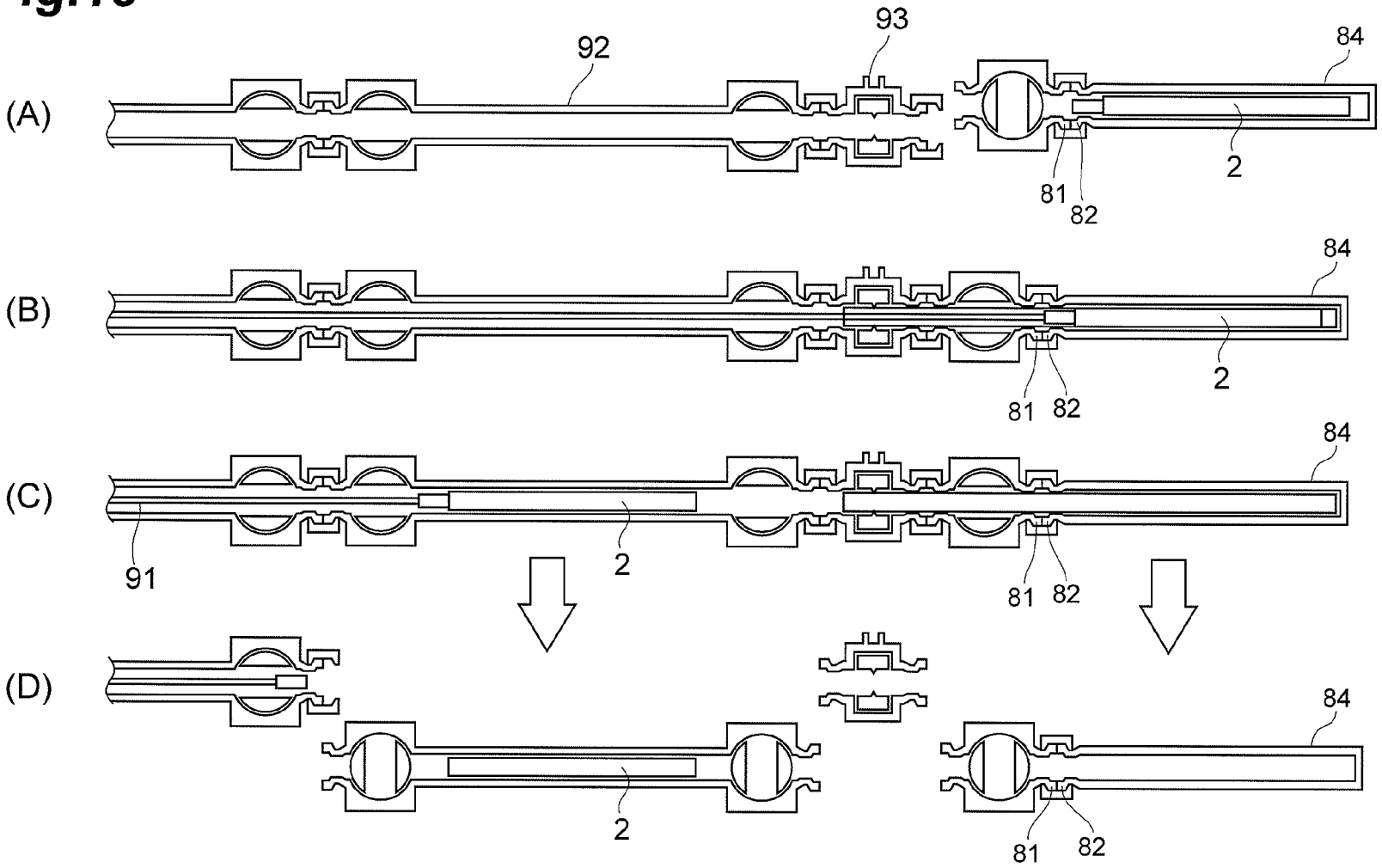
FIG. 18 is a conceptual view showing the procedure of transferring a core liner in the autoclave.

Referring to FIG. 18, the container transfer apparatus 90 will be described, and the procedure of drawing in the container including the core liner 13 will be described. First, the configuration of the container transfer apparatus 90 will be described. The container transfer apparatus 90 has a manipulator 91 which is a means for drawing in the core liner 13, a storage pressure container 92 which is a container for storing the core liner 13, and a liner cutter 93, which can cut the core liner 13 at a predetermined position. Further, a pressurizing device (not shown) is connected to any place of the container transfer apparatus 90. Next, the procedure of drawing in the core liner 13 will be described. First, as shown in FIG. 18(A), the clamp head 81 shown in FIGS. 17(A) and (B), the moving clamp head 82, and the moving bottom cap 84 are mounted on the autoclave 2, and then mounted on the container transfer apparatus 90. Meanwhile, a pressurizing device which is not shown (a fluid maintaining unit, a fluid supplying unit) is connected to the container transfer apparatus 90 and the inlet 83 of the moving clamp head 82, and pressurized water of equal pressure is injected. Thereby, the pressure of the inside of the container transfer apparatus 90 and the autoclave 2 is maintained.

Next, as shown in FIG. 18(B), the manipulator 91 (a container transfer unit) is connected to the upper portion of the autoclave and the manipulator 91 is pulled in, so that the core liner 13 in the autoclave 2 is pulled into the container transfer apparatus 90, as shown in FIG. 18(C). Then, the autoclave 2 is removed as shown in FIG. 18(D).

Thus, the container transfer apparatus 90 can supply the fluid according to the volume of the inside of the sealed space through the lip seal 32 and the check valve 30, when transferring the core liner 13 into the fluid of the container transfer apparatus 90. Further, even in the situation in which the sealed state is fixed by the lip seal, it is possible to transfer the container to the fluid that has flowed into the container transfer apparatus 90. Further, since the pressure of the fluid maintained by the fluid maintaining unit depends on the pressure of the fluid in the autoclave, it is possible to transfer the core liner 13 into the fluid of the container transfer apparatus 90 while maintaining the pressure in the autoclave. In the related art, the pressurized water is supplied from below the ball valve 20. But in the embodiment of the present invention, it is possible to supply the pressurized water from above the autoclave 2 using the lip seal 32, and the work is done simply and safely.

(Operation and Effects)

Next, the operation and effects of the embodiment of the present invention will be described. The core barrel 1 for sampling the core includes the inner tube 12, the core liner 13, which includes the sampling core and is movably disposed in the axial direction of the inner tube 12 in the outer tube 10, the ball valve 20 which is disposed at one opening side of the inner tube 12 to prevent the fluid from inflowing and outflowing between the inside and outside of the inner tube 12 through one opening portion in a closed state, the ball valve seal 22 which seals the space between the one opening portion of the inner tube 12 and the ball valve 20 in a state in which the ball valve 20 is closed, a member which seals the space between the outer peripheral surface of the core liner 13 and the inner peripheral surface of the inner tube 12 when the core liner 13 is positioned at a specific position in the axial direction of the inner tube 12, the locking mechanism for locking the sealed state by the ball valve seal 22, and the inflowing mechanism which can make the fluid flow in only the direction toward the internal space (the sealed space) of the closed barrel part by the first seal member and the second seal member. The inflowing mechanism includes at least one of the check valve 30 disposed at a position between the internal space of the inner tube 12 and the outside and the second seal member which is the lip seal 32.

The core barrel 1 has the locking mechanism for locking the sealed state after being sealed by the ball valve seal 22, whereby it is possible maintain the state that the ball valve is closed 20. Further, the core barrel 1 has the lip seal 32 or the check valve 30 which can make the fluid flow in only the internal space of the outer tube 10, whereby it is possible to flow the fluid into the outer tube 10. Therefore, it is possible to prevent the ball valve 20 from being opened again, since the core liner 13 is moved after the ball valve 20 is closed once, and thus the volume of the internal space of the barrel part increases to decrease the pressure. Therefore, the ball valve 20 is locked once, and the pressure tightness is maintained also for the change in external pressure due to vibration and drilling mud water circulation. Further, the pressure can be maintained even when the volume in the autoclave is changed due to the movement of the core liner 13. Further, it possible to maintain the pressure of the seabed if the internal pressure rise function by the accumulator is lost, and the redundancy of pressure maintenance is improved further by these effects. Furthermore, the existing drilling equipment, the drill pipe and the outer core barrel may be used for core drilling.

Further, in the related art, like the core barrel 1, it is difficult to perform the processes after determining whether each part is sealed or not when each part is sealed while being pulled up by the wire. But the embodiment of the present invention can reliably form the sealed space since the inner tube 12 and the outer tube 10 are processed to be sealed after securing the sealed state by closing the ball valve 20.

The ball valve 20 may be opened and closed by rotating about the rotary axis while moving in the axial direction of the outer tube 10, etc., and it is possible to further include the ball follower 17, etc. that supports the ball valve 20 movably. According to this configuration, the core barrel 1 can move the ball valve 20 by rotating the ball valve 20, and the ball valve 20 can be supported by the ball follower 17.

The core barrel 1 may include the seal carrier 23 in which the gap with the ball valve 20 is sealed by the ball valve seal 22, and the inner tube 12 which covers at least a part of the outer peripheral surface of the seal carrier 23 and is movably disposed together with the seal carrier 23. The locking mechanism includes the ball follower 17 which supports the ball valve 20 on the side sealed by the ball valve seal 22 and on the opposite side in the axial direction of the outer tube 10, etc. in the state in which the ball valve 20 is closed; a groove formed in the circumferential direction at the position where does not cover the seal carrier 23 of the inner peripheral surface of the drive sub 11, etc.; and the spring collet 24 which has the claw portion formed so as to protrude to the outer peripheral surface fitted in the groove of the inner tube 12, etc., and locks the seal carrier 23 to the ball valve by fitting the claw portion into the groove in the state in which the ball valve 20 is closed, and has the flange portion 48. The ball valve spring 25 may be disposed on the side opposite to the ball valve 20 in the outer periphery of the spring collet 24, and the spring collet 24 is pressed by the biasing force of the ball valve spring 25 that presses the flange portion 48 to the ball valve 20 side, so that the seal carrier 23 is pressed so as to lock the seal carrier 23.

According to this configuration, in the core barrel 1, the claw portion formed to protrude out of the outer peripheral surface of the spring collet 24 is fitted into the groove formed on the inner peripheral surface of the drive sub 11, so that the spring collet 24 and the seal carrier 23 are locked with respect to the drive sub 11. In the ball valve 20 that is supported so as to be sandwiched between the seal carrier 23 and the ball follower 17, the seal carrier 23 located at the upper portion of the ball valve 20 is locked and becomes immovable, whereby the ball valve 20 is locked with respect to the drive sub 11, and the sealed state of the autoclave can be maintained by the ball valve seal 22, the ball valve 20 and the seal carrier 23.

The groove of the drive sub 11 may be formed by a convex portion formed on the inner peripheral surface of the drive sub 11, and may be disposed at a predetermined interval in the circumferential direction on the inner peripheral surface of the drive sub 11, and the claw portion of the spring collet 24 may be formed on the outer peripheral surface of the spring collet 24 at an interval longer than the interval of the groove of the drive sub 11, and the seal carrier 23 and the spring collet 24 can be connected to each other. According to this configuration, in the core barrel 1, if the seal carrier 23 is rotated by the seal carrier 23 and the spring collet 24 connected to each other, the spring collet 24 can also be rotated, the claw fitted into the groove is unlatched from the groove by this rotation, and the locked state of the drive sub 11 and the spring collet 24 can be released.

The spring collet 24 may include a second claw formed at the ball valve 20 side from the claw portion and arranged alternately with the claw portion in the circumferential direction, the drive sub 11 further includes a second convex portion which is formed at the other opening portion side of the convex portion and has a slope that increases toward the other opening portion, and the distance from the claw portion to the second claw portion is longer than the distance from the convex portion to the second convex portion. According to this configuration, the core barrel 1 has the seal carrier 23 and the spring collet 24 connected to each other, so if the seal carrier 23 is rotated, the spring collet 24 can also be rotated, and the claw fitted into the groove is unlatched therefrom by this rotation. If the carrier is pushed upward in this state and is further rotated with the second claw connected to the groove, then it is possible to return to the original state.

The core barrel 1 may include the seal carrier 23 whose gap with the ball valve 20 is sealed by the ball valve seal 22 and the drive sub 11 that covers at least a part of the outer peripheral surface of the seal carrier 23 and is movably disposed with respect to the seal carrier 23, the locking mechanism includes the ball follower 17 which supports the ball valve 20 on the side sealed by the ball valve seal 22 and the side opposite to the inner tube 12 or the like in the axial direction in the state in which the ball valve 20 is closed, the outward openable slit 62 which is mounted on the outer peripheral surface of the seal carrier 23 and is expanded in the radial direction of the seal carrier 23 toward the inner tube 12 from the ball valve 20, and the ball valve housing 19 which is locked to the barrel part body and abuts the outward openable slit 62 in the state in which the ball valve 20 is closed.

The ball valve 20 may have an opening and closing control groove for controlling the opening and closing of the ball valve 20, and in the opening and closing groove, the position corresponding to the state that the ball valve is closed 20 is deeper than the other position; and the locking mechanism may include a pin which is positioned in the opening and closing control groove and configured to be pressed to a position corresponding to the state in which the ball valve is closed. According to this configuration, in the core barrel 1, the operation of the ball valve is locked due to the pin being fixed, so it is possible to maintain the sealed state of the first seal member. Since this pin portion is mounted by the screw, it is possible to open the ball valve by loosening the screw and pressing the ball follower 17 from below as described above to move upward, in the state in which the pin portion is unlatched from the groove. Then, it is possible to reset the mechanism by twisting the pin to a predetermined twist position.

According to the embodiment of the present invention, it is possible to recover the core to the ground while maintaining the pressure of the seabed.

What is claimed is:

1. A core sampling apparatus which samples a core, comprising:

a barrel part;

a container which is movably disposed in the barrel part in an axial direction of the barrel part and maintains the sampled core;

a ball valve which is disposed at one opening portion side of the barrel part to prevent a fluid from inflowing and outflowing between an inside and an outside of the barrel part through the one opening portion in a closed state thereof;

a first seal member which seals a space between the one opening portion of the barrel part and the ball valve in the state that the ball valve is closed;

a second seal member which seals a space between an outer peripheral surface of the container and an inner peripheral surface of the barrel part when the container is positioned at a specific position in the axial direction of the barrel part;

a locking mechanism which locks a state in which the ball valve is sealed by the first seal member; and an inflowing mechanism configured to inflow the fluid only in a direction to an internal space of the closed barrel part by the first seal member and the second seal member, wherein the inflowing mechanism comprises at least one of a check valve disposed at a position between the internal space of the barrel part and an outside thereof, and the second seal member which is a lip seal, wherein the ball valve opens and closes by rotating about a rotary axis while moving in the axial direction of the barrel part, the core sampling apparatus further comprises a supporting part which movably supports the ball valve, wherein the barrel part comprises:

a sealing barrel part whose gap with the ball valve is sealed by the first seal member; and a barrel part body which covers at least a part of an outer peripheral surface of the sealing barrel part and is movably disposed together with the sealing barrel part, wherein the locking mechanism comprises:

the supporting part which supports the ball valve from a side opposite to a side sealed by the first seal member in the axial direction of the barrel part, in a state in which the ball valve is closed;

a groove which is formed in a circumferential direction at a position that does not cover the sealing barrel part on an inner peripheral surface of the barrel part body; and a locking barrel part which has a flange portion, and a claw portion formed to protrude out of the outer peripheral surface, wherein the claw portion is fitted into the groove of the barrel part body in the state in which the ball valve is closed, and the sealing barrel part is locked with respect to the ball valve as the claw portion is fitted into the groove, and wherein the locking barrel has an elastic body disposed at a side opposite to the ball valve in an outer periphery of the locking barrel part, and the locking barrel part is pressed by a biasing force of the elastic body that presses the flange portion to the ball valve side, so that the sealing barrel part is pressed so as to lock the sealing barrel part.

2. The core sampling apparatus according to claim 1, wherein the groove of the barrel part body is formed by a convex portion formed on the inner peripheral surface of the barrel part body, and is disposed at a predetermined interval in the circumferential direction on the inner peripheral surface of the barrel part body, the claw portion of the locking barrel part is formed on the outer peripheral surface of the locking barrel part at an interval longer than the interval between the grooves of the barrel part body, and the sealing barrel part and the locking barrel part are connected to each other.

3. The core sampling apparatus according to claim 2, wherein the locking barrel part has a second claw portion alternately arranged with the claw portion in the circumferential direction of the outer peripheral surface and formed at the ball valve side relative to the claw portion and, the barrel part body further includes a second convex portion which is formed at the other opening portion side of the convex portion that forms the groove on the inner peripheral surface of the barrel part body and has a slope that increases toward the other opening portion, and a distance from the claw portion to the second claw portion is longer than a distance from the convex portion to the second convex portion.

4. A core sampling apparatus which samples a core, comprising:

a barrel part;

a container which is movably disposed in the barrel part in an axial direction of the barrel part and maintains the sampled core;

a ball valve which is disposed at one opening portion side of the barrel part to prevent a fluid from inflowing and outflowing between an inside and an outside of the barrel part through the one opening portion in a closed state thereof;

a first seal member which seals a space between the one opening portion of the barrel part and the ball valve in the state that the ball valve is closed;

a second seal member which seals a space between an outer peripheral surface of the container and an inner peripheral surface of the barrel part when the container is positioned at a specific position in the axial direction of the barrel part;

a locking mechanism which locks a state in which the ball valve is sealed by the first seal member; and an inflowing mechanism configured to inflow the fluid only in a direction to an internal space of the closed barrel part by the first seal member and the second seal member, wherein the inflowing mechanism comprises at least one of a check valve disposed at a position between the internal space of the barrel part and an outside thereof, and the second seal member which is a lip seal, wherein the ball valve opens and closes by rotating about a rotary axis while moving in the axial direction of the barrel part, and the core sampling apparatus further comprises a supporting part which movably supports the ball valve, wherein the barrel part comprises:

a sealing barrel part whose gap with the ball valve is sealed by the first seal member; and a barrel part body which covers at least a part of an outer peripheral surface of the sealing barrel part and is movably disposed with respect to the sealing barrel part, and wherein the locking mechanism comprises:

the supporting part which supports the ball valve from a side opposite to a side sealed by the first seal member in the axial direction of the barrel part, in a state in which the ball valve is closed;

a blade portion which is mounted on the outer peripheral surface of the sealing barrel part and is expanded in the radial direction of the sealing barrel part toward the barrel part from the ball valve; and a blade supporting part which is locked to the barrel part body, and abuts blade portion in the state in which the ball valve is closed.

5. The core sampling apparatus according to claim 4, wherein the ball valve has an opening and closing control groove that controls the opening and closing of the ball valve;

in the opening and closing control groove, the position corresponding to the state that the ball valve is closed is deeper than another position, and the locking mechanism includes a pin which is positioned in the opening and closing control groove, and configured to be pressed to a position corresponding the state in which the ball valve is closed.

* * * * *